United States Patent [19]

Kjaer

[11] Patent Number: 4,603,386

[45] Date of Patent: Jul. 29, 1986

[54] APPARATUS AND METHOD FOR INPUTTING MUSICAL SHEET DATA INTO A MUSICAL-SHEET-PRINTING SYSTEM

[75] Inventor: Mogens Kjaer, Tokyo, Japan

[73] Assignee: Toppan Printing Co., Ltd., Tokyo, Japan

[21] Appl. No.: 597,687

[22] Filed: Apr. 6, 1984

[30] Foreign Application Priority Data

Apr. 8, 1983 [JP] Japan ..... 58-61603

[51] Int. Cl.[4] ..... B41J 3/34; B41J 11/40; G06G 7/60; G10G 3/00

[52] U.S. Cl. ..... 364/419; 400/116; 400/117; 283/47; 84/461

[58] Field of Search ..... 364/419; 400/117, 116; 283/47; 84/461

[56] References Cited

U.S. PATENT DOCUMENTS

| | | | |
|---|---|---|---|
| 3,331,271 | 6/1964 | Glenn | 283/47 X |
| 3,698,277 | 10/1972 | Barra | 283/47 X |
| 3,700,785 | 10/1972 | Leonard | 283/47 |
| 4,104,949 | 8/1978 | Clark | 400/117 X |
| 4,215,343 | 7/1980 | Ejiri et al. | 400/117 X |

FOREIGN PATENT DOCUMENTS

| | | | |
|---|---|---|---|
| 53393 | 6/1982 | European Pat. Off. . | |
| 0045979 | 3/1983 | Japan | 400/117 |
| 0211486 | 12/1983 | Japan | 400/117 |
| 1337201 | 11/1973 | United Kingdom . | |
| 2009999 | 6/1979 | United Kingdom | 283/47 |

OTHER PUBLICATIONS

IBM Technical Disclosure Bulletin, vol. 24, No. 2, p. 960, "Chord Spelling and Melody Translation".

*Primary Examiner*—Charles E. Atkinson
*Assistant Examiner*—Charles B. Meyer
*Attorney, Agent, or Firm*—Bacon & Thomas

[57] ABSTRACT

An apparatus for inputting musical sheet data into a musical-sheet-printing system has a piano keyboard which has diatonic tone keys and chromatic tone keys and which generates first coded data, a function keyboard, a random access memory (RAM) for storing coded data supplied from these keyboards, a read-only memory for storing a permanent program and a conversion table representing a relationship between tonality values and chromatic tone pitches, and a control unit, under the control of the permanent program, for presetting a predetermined number of note data for the coded musical data, storing in the RAM the respective musical data included in the predetermined number of note data, accumulating the respective note data, calculating the respective entropy data in accordance with the accumulated musical data, selecting a tonality value having a maximum entropy, and determining an accidental and a note in accordance with the selected tonality value with reference to the conversion table. A method of entering note data in the musical-sheet-printing system has a step for receiving pitch data, a step for sorting and accumulating them in accordance with the number of times of occurrence thereof, a step for classifying pitch data of all scales into 12 groups, each scale having 7 pitch data and generating the 12-grouped pitch data, a step for calculating entropies of 12 groups in accordance with an equation $$H = -\sum_{i=1}^{N} Pi\log_2 Pi$$

(H: entropy; Pi: probability of the number of times of occurence) and selecting a maximum entropy, and a step for determining the corresponding accidental and tone in accordance with the conversion table.

11 Claims, 42 Drawing Figures

33

APPARATUS AND METHOD FOR INPUTTING MUSICAL SHEET DATA INTO A MUSICAL-SHEET-PRINTING SYSTEM

BACKGROUND OF THE INVENTION

The present invention relates to an apparatus and method for inputting musical sheet data into a musical-sheet-printing system so as to perform printing of music in accordance with the input musical sheet data.

Generally, musical note data among musical sheet data are very important. Various types of methods have been proposed to enter and process musical note data. A typical example of note data input apparatus is disclosed in EPC Provisional Publication No. 53393. According to this apparatus, the note data is entered together with pitch data and duration data at a function keyboard. When an accidental such as a sharp "#" or a flat "b" is required for a given note, the corresponding "accidental" function key is depressed to enter the note data with the corresponding accidental. The pitch and duration data of the note must be entered at the keyboard, which hinders smooth data entry. For example, when a chord such as a triad or the like is played, the respective notes making up the chord must be entered independently.

A musical sheet to be printed is generally handwritten. If the musical sheet data are entered as if an operator is playing the piano, pitch data entry can be performed at high speed. A method for entering the pitch data at a piano-keyboard input unit is disclosed in British Pat. No. 1,337,201. According to this method, musical note data can be smoothly entered with function keys irrespective of chord data entry and single note data entry. An accidental can be easily entered by depressing a corresponding black key of the keyboard. However, this prior art has the following problem. There are two ways notating accidentals on a musical sheet. In particular, any semitone must specify which accidental (sharp or flat) is added thereto. For this reason, smooth keyboard playing (i.e., smooth data input) is interrupted, and data input errors tend to occur.

SUMMARY OF THE INVENTION

It is, therefore, an object of the present invention to provide an apparatus for inputting musical sheet data into a musical-sheet-printing system, wherein current tonality is automatically determined without requiring depression of a "#" or "b" key even if an accidental is required, and a method of entering musical sheet data.

According to the apparatus and method in the musical-sheet-printing system of this invention, entropy data of notes included in a predetermined number of note data to be processed is determined, and the corresponding accidental data is determined in accordance with the entropy data.

In general, the newer the note data (musical data), the better for determining the tonality, and naturally the older the musical data, the lower its contribution to the tonality determination. In view of the situation, the present invention permits the number of new note data to be set at a given value and employs expire rate conception.

According to the apparatus and method of the present invention, a tone and its accidental can be automatically determined. Therefore, high-speed, accurate data entry can be performed.

In order to achieve the above object of the present invention, there is provided an apparatus for inputting musical sheet data into a musical sheet-printing system, comprising:

first musical keyboard means, having diatonic scale keys and chromatic scale keys, for allowing simultaneous entry of a plurality of notes and for generating first coded musical data;

second musical keyboard means, having a plurality of function keys and alphanumeric keys, for generating second coded musical data;

memory means, connected to said first and second musical keyboard means, for storing the first and second coded musical data; and controlling means for performing a predetermined operation on the first and second coded musical data and determining a tone and an accidental thereof.

In order to achieve the above object of the present invention, there is further provided a method of entering musical sheet data in a musical sheet-printing system, comprising the steps of:

receiving pitch data;

classifying the pitch data in accordance with pitches thereof and accumulating the number of times pitch data occurs for the respective pitches;

classifying into 12 groups seven types of pitch data in a diatonic scale in accordance with accumulated data and generating grouped pitch data;

calculating an entropy of each group of said 12 groups in the diatonic scale in accordance with a relation:

$$H = -\sum_{i=1}^{N} Pi\log_2 Pi$$

where H is the entropy and Pi is the probability of occurence;

selecting a maximum entropy for the 12 groups entropies; and determining an accidental and a tone of the input data referring to a conversion table representing a relationship between tonality and pitches of chromatic tones.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENT

Figure 1A:
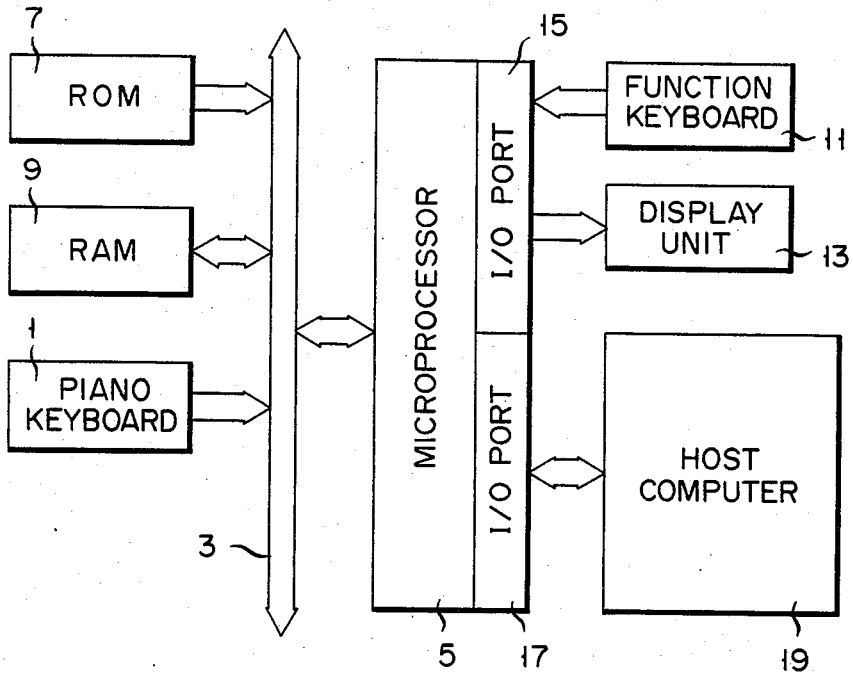
FIGS. 1A and 1B are schematic block diagrams of a musical sheet-printing system to which a musical data-input apparatus and method is applied.
Figure 1B:
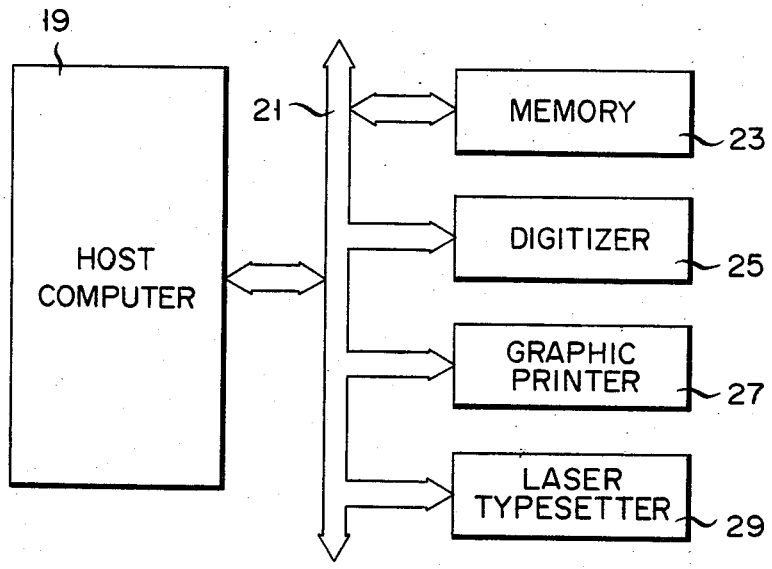
Figure 2A:
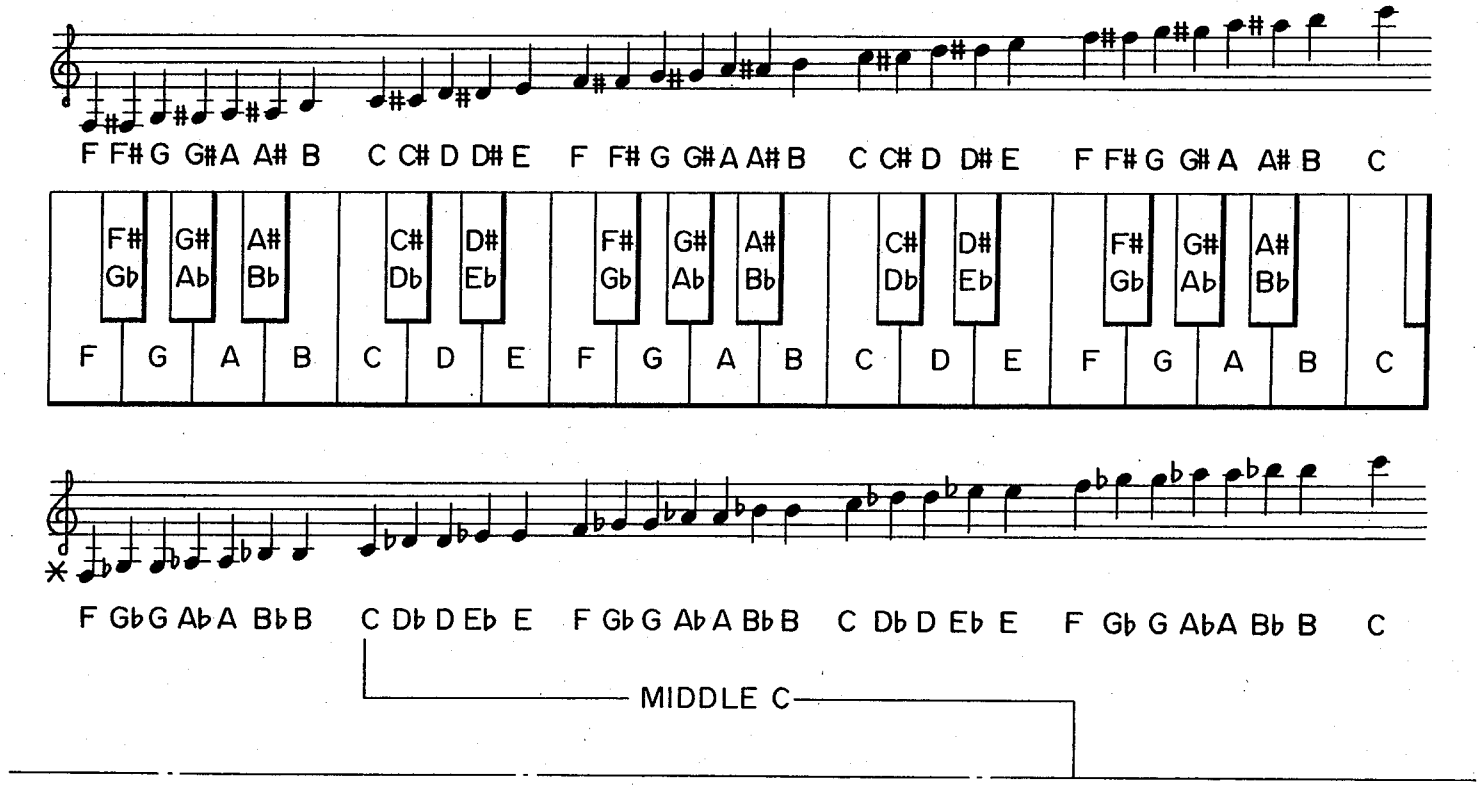
FIGS. 2A and 2B are representations showing a relationship between keys of a piano keyboard and notes.
Figure 2B:
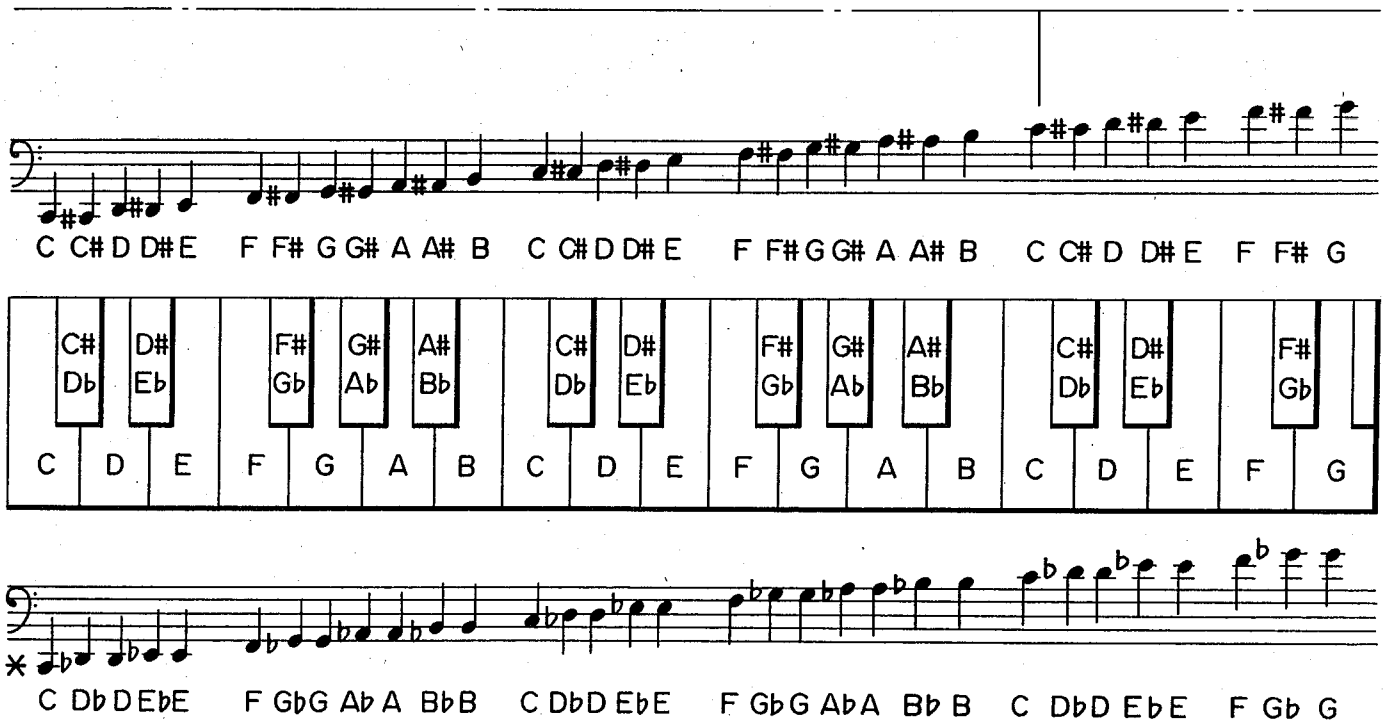
Figure 3A:
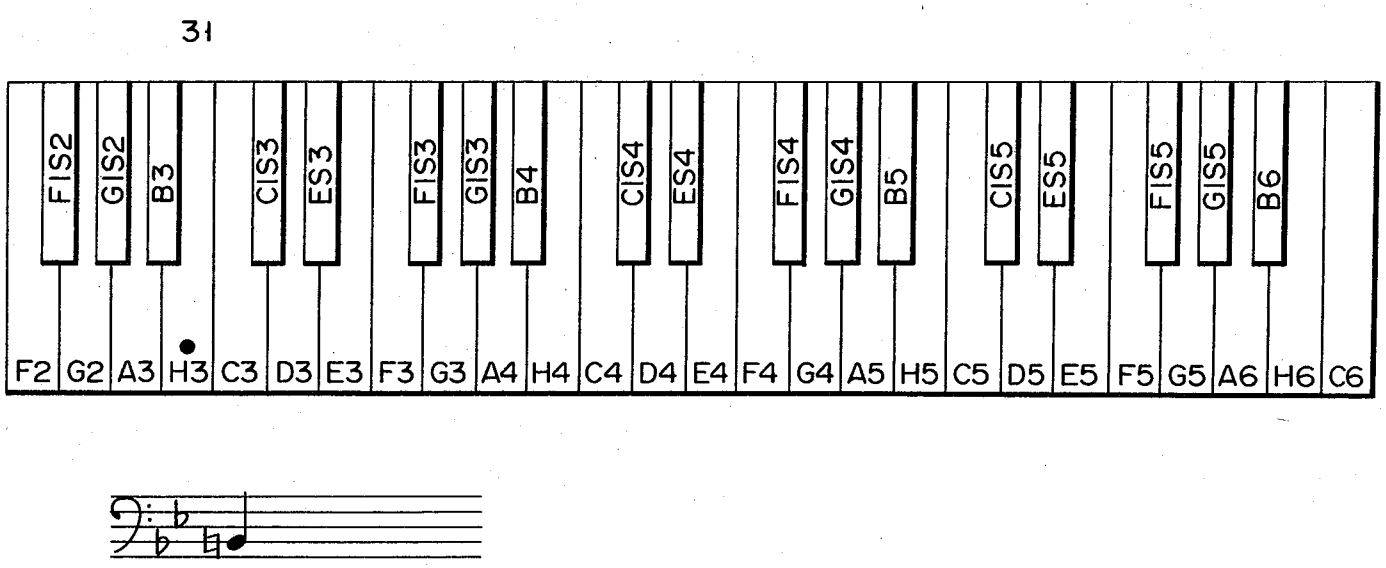
FIGS. 3A to 3D are respectively representations for explaining musical data entry at the keyboard.
Figure 3B:
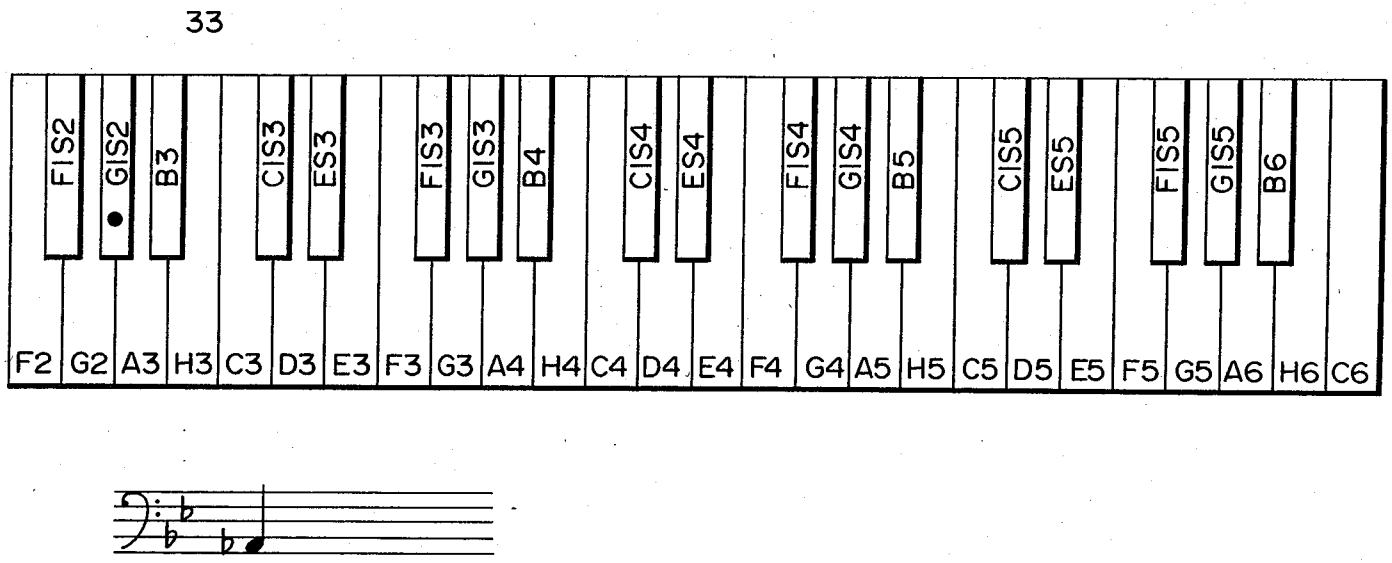
Figure 3C:
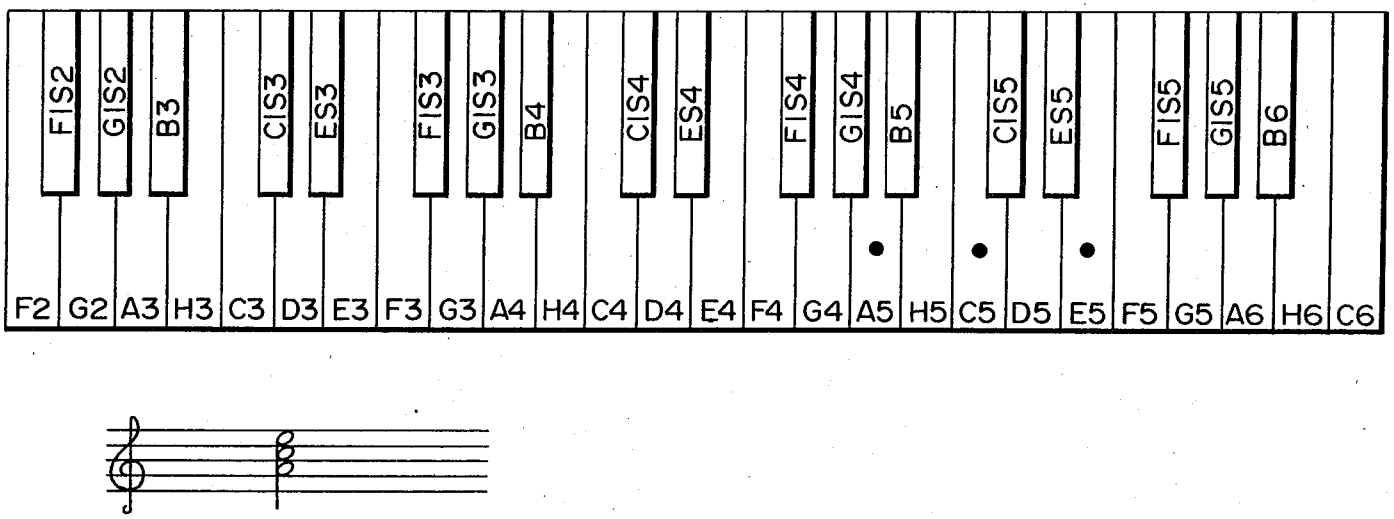
Figure 3D:
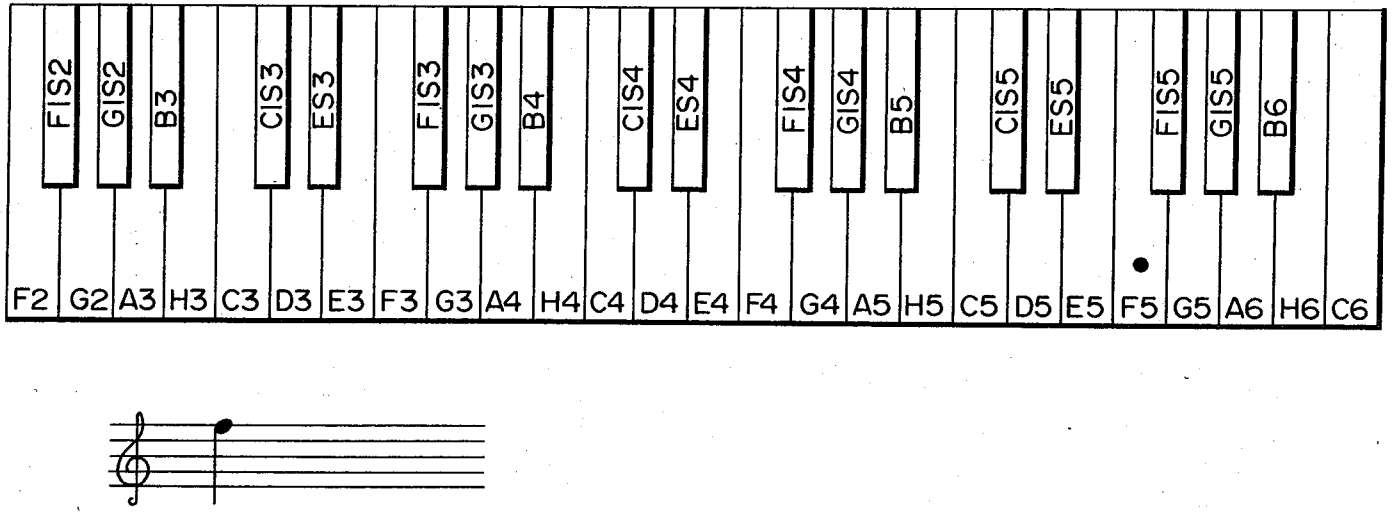

FIGS. 1A and 1B are schematic block diagrams showing a musical-sheet-printing system to which a musical-sheet data-input apparatus and method, according to the present invention, are applied. Referring to FIGS. 1A and 1B, a piano keyboard 1 is connected to a microprocessor 5 through a data bus 3. The keyboard 1 comprises 26 white keys and 18 black keys. A coded musical signal is generated by depressing one of the white or black keys. FIGS. 2A and 2B show the relationship between treble and bass notes and the corresponding keys.

FIGS. 3A to 3D show the relationships between a note with a natural and the corresponding key, between a note with a flat and the corresponding key, between a triad and the corresponding keys, and between a treble note and the corresponding key, respectively. These musical data can be easily entered in a one-touch manner unlike the conventional musical data entry.

Figure 4:
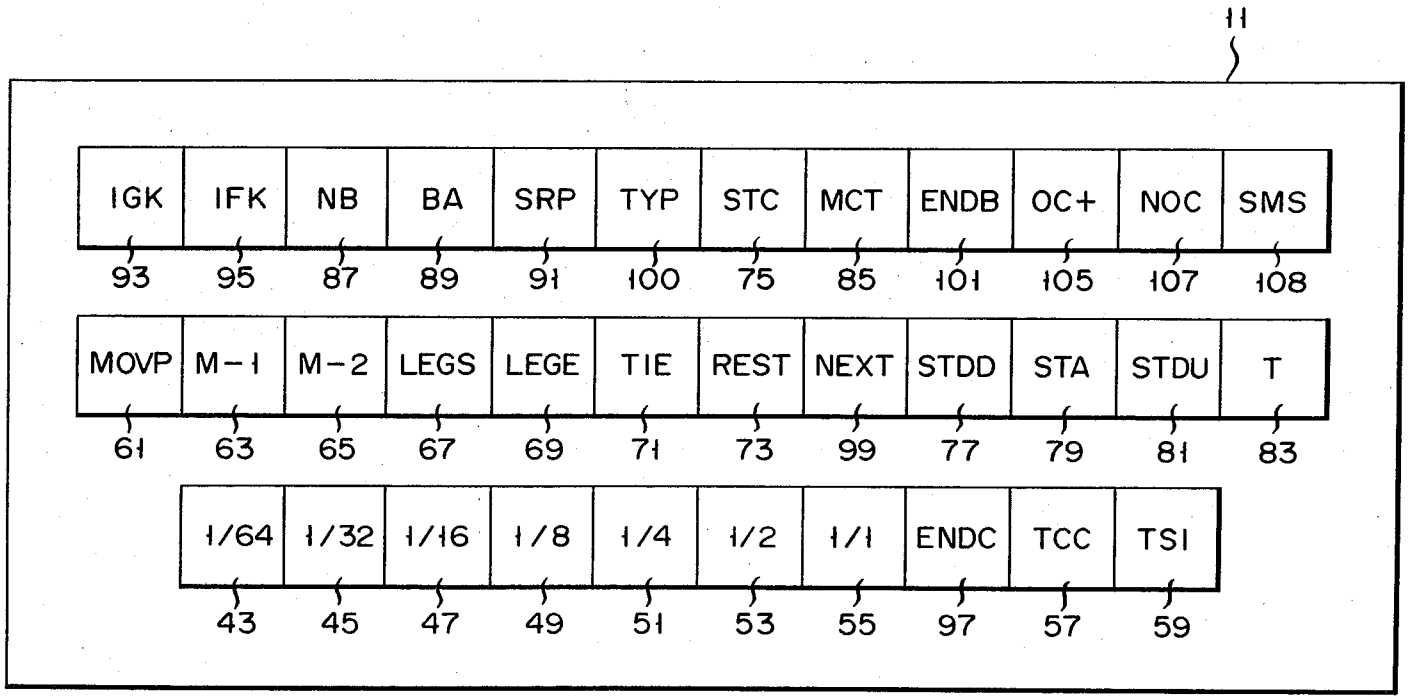
FIG. 4 is a representation showing a function keyboard of the input apparatus shown in FIG. 1.

Referring again to FIG. 1A, a read-only memory (to be referred to as a ROM hereafter) 7 and a random access memory (to be referred to as a RAM hereinafter ) 9 are connected to the microprocessor 5 through the data bus 3. The microprocessor 5 comprises, for example, a microprocessor Model 9900 available from Texas Intruments Inc., U.S.A. The ROM 7 stores a control program for controlling a function keyboard 11 and a display unit 13, which will be described in detail later, a communication program for causing the musical sheet-printing system to communicate with a host computer 19, and a program for calculating the entropy of a note included in a predetermined number of note data to be processed. The function keyboard 11 and the display unit 13 are connected to the microprocessor 5 through an I/O port 15. The function keyboard 11 has various keys for entering musical data, as shown in FIG. 4. Table 1 shows a relationship between the function keys and their functions.

TABLE 1

| Key | Reference numeral | Function |
|---|---|---|
| 1/64 | 43 | sixty-fourth note (1/16 time) |
| 1/32 | 45 | thirty-second note (1/8 time) |
| 1/16 | 47 | sixteenth note (1/4 time) |
| 1/8 | 49 | eighth note (1/2 time) |
| 1/4 | 51 | quarter note (1 time) |
| 1/2 | 53 | half note (2 times) |
| 1/1 | 55 | whole note (4 times) |

TABLE 1-continued

| Key | Reference numeral | Function |
|---|---|---|
| TCC | 57 | time signature C |
| TSI | 59 | non-display of a time signature |
| MOVP | 61 | return to a specified measure |
| M-1 | 63 | beginning of a stroke of a group of notes |
| M-2 | 65 | end of the stroke |
| LEGS | 67 | beginning of slur |
| LEGE | 69 | end of slur |
| TIE | 71 | beginning of a tie (the end of the tie need not be specified) |
| REST | 73 | rest |
| STC | 75 | staccato |
| STDO | 77 | downward stem |
| STA | 79 | automatic stem direction determination |
| STDU | 81 | upward stem |
| T | 83 | beginning of a time signature |
| MCT | 85 | marcato |
| NB | 87 | number of measures |
| BA | 89 | measure number |
| SRP | 91 | repeat mark |
| IGK | 93 | alto clef |
| IFK | 95 | bass clef |
| ENDC | 97 | end of key input |
| NEXT | 99 | music data input for the next part |
| TYP | 100 | layout typing |
| ENDB | 101 | end of down beat |
| OC− | 103 | increase by one octave (music is played at one octave lower.) |
| OC+ | 105 | decrease by one octave (music is played at one octave higher.) |
| NOC | 107 | return to the normal octave |
| SMS | 108 | description on the same musical sheet |

The function keyboard 11 further comprises alphanumeric keys which are omitted for illustrative convenience.

Input data from the function keyboard 11 is displayed at the display unit 13.

The microprocessor 5 (to be referred to as a CPU hereafter) is connected to the host computer 19 through an I/O port 17. Edited musical data is transferred from the CPU 5 to the host computer 19. The host computer 19 is connected through a data bus 21 to a memory 23, a digitizer 25, a graphic printer 27, and a laser type setter 29. The host computer 19 comprises, for example, a computer VAX 780 available from Digital Equipment Corp., U.S.A. The edited musical data transferred from the CPU 5 is printed out at the graphic printer 27. Input error correction and expression term and mark entry are performed by the digitizer 25 by referring to a hard copy. The musical data, including the expression terms and marks after input data correction, are supplied to the laser type setter 29, thereby forming a block copy. The data entered at the piano keyboard 1 and the function keyboard 11 are stored in the RAM 9.

The operation will now be described wherein tonality and the corresponding accidental are automatically determined when a note with an accidental is entered. An entropy of the input musical data is calculated. According to the information theory, in a perfect phenomenon type information source $$X = \begin{pmatrix} A1, A2, \ldots, An \\ P1, P2, \ldots, Pn \end{pmatrix}$$

wherein the probability of appearance of each message or symbol in a set of messages {A1, A2, . . . , An} is given to be P1, P2, . . . , Pn $$\left( Pi \geqq 0 \sum_{i=1}^{N} Pi = 1 \right),$$

the average information content is defined by $$H(X) = -\sum_{i=1}^{N} Pi \log_2 Pi.$$

The left-hand side (e.g., H(X)) of this equation is defined as the entropy.

The chromatic scale is obtained by dividing one octave into 12 portions. Each tone is called a chromatic tone. Seven tones are extracted from these chromatic tones in accordance with the following tone intervals:

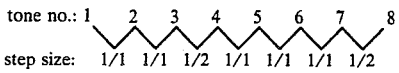

(1)

The above scale is called a diatonic scale. Since the chromatic scale consists of 12 tones, all the tones of the diatonic scale can be shifted to any of the 12 different positions of the chromatic scale. Tone shifting represents tonality. Therefore, a repertoire of 12 tones can be extracted from the main repertoire of tones (chromatic tones). This tonality is determined in accordance with the first key of a given scale. In the system of the present invention, a major key is not distinguished from a minor key.

In this embodiment, tonality is only used to determine the corresponding accidental. A given scale can be applied as a major or minor scale, so the major scale need not be distinguished from the minor scale.

Table 2 shows tonal relationships and their numeric values.

TABLE 2

| | |
|---|---|
| G♭ major/E♭ minor | −6 |
| D♭ major/B♭ minor | −5 |
| A♭ major/F minor | −4 |
| E♭ major/C minor | −3 |
| B♭ major/G minor | −2 |
| F major/D minor | −1 |
| C major/A minor | 0 |
| G major/E minor | +1 |
| D major/B minor | +2 |
| A major/F♯ minor | +3 |
| E major/C♯ minor | +4 |
| B major/G♯ minor | +5 |
| F♯ major/D♯ minor | +6 |

Table 3 shows the tonality of the diatonic scale derived from the chromatic scale. Table 4 is used for determining accidentals on the basis of the tonality given in Table 3.

TABLE 3

| | Diatonic Scale Derived from Chromatic Scale | | | | | | | | | | | |
|---|---|---|---|---|---|---|---|---|---|---|---|---|
| | A 1 | A♯/B♭ 2 | B/C♭ 3 | B♯/C 4 | C♯/D♭ 5 | D 6 | D♯/E♭ 7 | E/F♭ 8 | E♯/F 9 | F♯/G♭ 10 | G 11 | G♯/A♭ 12 |
| −6 G♭ major/E♭ minor | | B♭ | C♭ | | D♭ | | E♭ | | F | G♭ | | A♭ |
| −5 D♭ major/B♭ minor | | B♭ | | C | D♭ | | E♭ | | F | G♭ | | A♭ |
| −4 A♭ major/F minor | | B♭ | | C | D♭ | | E♭ | | F | | G | A♭ |
| −3 E♭ major/C minor | | B♭ | | C | | D | E♭ | | F | | G | A♭ |
| −2 B♭ major/G minor | A | B♭ | | C | | D | E♭ | | F | | G | |
| −1 F major/D minor | A | B♭ | | C | | D | | E | F | | G | |
| 0 C major/A minor | A | | B | C | | D | | E | F | | G | |
| +1 G major/E minor | A | | B | C | | D | | E | | F♯ | G | |
| +2 D major/B minor | A | | B | | C♯ | D | | E | | F♯ | G | |
| +3 A major/F♯ minor | A | | B | | C♯ | D | | E | | F♯ | | G♯ |
| +4 E major/C♯ minor | A | | B | | C♯ | | D♯ | E | | F♯ | | G♯ |
| +5 B major/G♯ minor | | A♯ | B | | C♯ | | D♯ | E | | F♯ | | G♯ |
| +6 F♯ major/D♯ minor | | A♯ | B | | C♯ | | D♯ | | E♯ | F♯ | | G♯ |

TABLE 4

| | | −6 | −5 | −4 | −3 | −2 | −1 | 0 | +1 ♯ | +2 ♯♯ | +3 | +4 | +5 | +6 |
|---|---|---|---|---|---|---|---|---|---|---|---|---|---|---|
| A | 1 | A | A | A | A | A | A | A | A | A | A | A | A | A |
| A♯/B♭ | 2 | B♭ | B♭ | B♭ | B♭ | B♭ | B♭ | B♭ | B♭ | A♯ | A♯ | A♯ | A♯ | A♯ |
| B/C♭ | 3 | C♭ | C♭ | C♭ | B | B | B | B | B | B | B | B | B | B |
| B♯/C | 4 | C | C | C | C | C | C | C | C | C | C | B♯ | B♯ | B♯ |
| C♯/D♭ | 5 | D♭ | D♭ | D♭ | D♭ | D♭ | D♯ | C♯ | C♯ | C♯ | C♯ | C♯ | C♯ | C♯ |
| D | 6 | D | D | D | D | D | D | D | D | D | D | D | D | D |
| D♯/E♭ | 7 | E♭ | E♭ | E♭ | E♭ | E♭ | E♭ | E♭ | D♯ | D♯ | D♯ | D♯ | D♯ | D♯ |
| E/F♭ | 8 | F♭ | F♭ | E | E | E | E | E | E | E | E | E | E | E |
| E♯/F | 9 | F | F | F | F | F | F | F | F | F | E♯ | E♯ | E♯ | E♯ |
| F♯/G♭ | 10 | G♭ | G♭ | G♭ | G♭ | F♯ | F♯ | F♯ | F♯ | F♯ | F♯ | F♯ | F♯ | F♯ |
| G | 11 | G | G | G | G | G | G | G | G | G | G | G | G | G |
| G♯/A♭ | 12 | A♭ | A♭ | A♭ | A♭ | A♭ | A♭ | G♯ | G♯ | G♯ | G♯ | G♯ | G♯ | G♯ |

The relationship between a composer and audience is given as follows. The audience must spontaneously select a suitable one of the scales when the composer uses a modulation and an accidental in a plurality of scales. The audience can determine that a melody corresponds to tones of one of the 12 types of scales (i.e., he can determine which scale provides a maximum number of occurrences of music data). In other words, the audience can select a tonic relationship which has a maximum entropy. According to the present invention, the composer corresponds to the operator and the audience corresponds to the computer. The computer detects which scale is suitable for the currently played melody (i.e., which tones have the maximum number of occurrences in the input tone data). In other words, the computer detects which scale has the maximum tonality entropy. Therefore, the computer determines that the input tone actually entered by the operator corresponds to the corresponding tone (scale/tonality) of the scale with the tonality having the maximum tonality entropy. In general, the entropy becomes maximum for $P=1/n$, where P is the probability and n is the number of phenomena. The maximum entropies of the scales are obtained as shown in Table 5.

TABLE 5

| Scale | Number of tones of scale | Maximum tonality entropy |
|---|---|---|
| Pentatonic scale | 5 | 2.32 bits |
| Diatonic scale | 7 | 2.31 bits |
| Atonal chromatic scale | 12 | 3.59 bits |

The above values are used to detect whether or not a tonal tone is present in a measure or bar. According to experimental results (FIGS. 9 and 10), the current chromatic-scale tonality entropy is set to be 3.59 bits. When atonal tone is present in a given measure, the number of tone data to be processed changes. Alternatively, further tonal analysis is not performed and the given measure is received as an atonal measure. In the latter case, another rule is applied to select the proper accidental.

The current tonal determination will be described with reference to FIGS. 5A to 5D and FIG. 6. In this embodiment, the number of note data to be processed is 12, as indicated in a block 327 in FIG. 6. Every time the piano keyboard 1 is operated, the window is shifted by one note data. Therefore, the oldest note data is excluded from the window and the newly input note data is fetched therein.

Figure 5A:
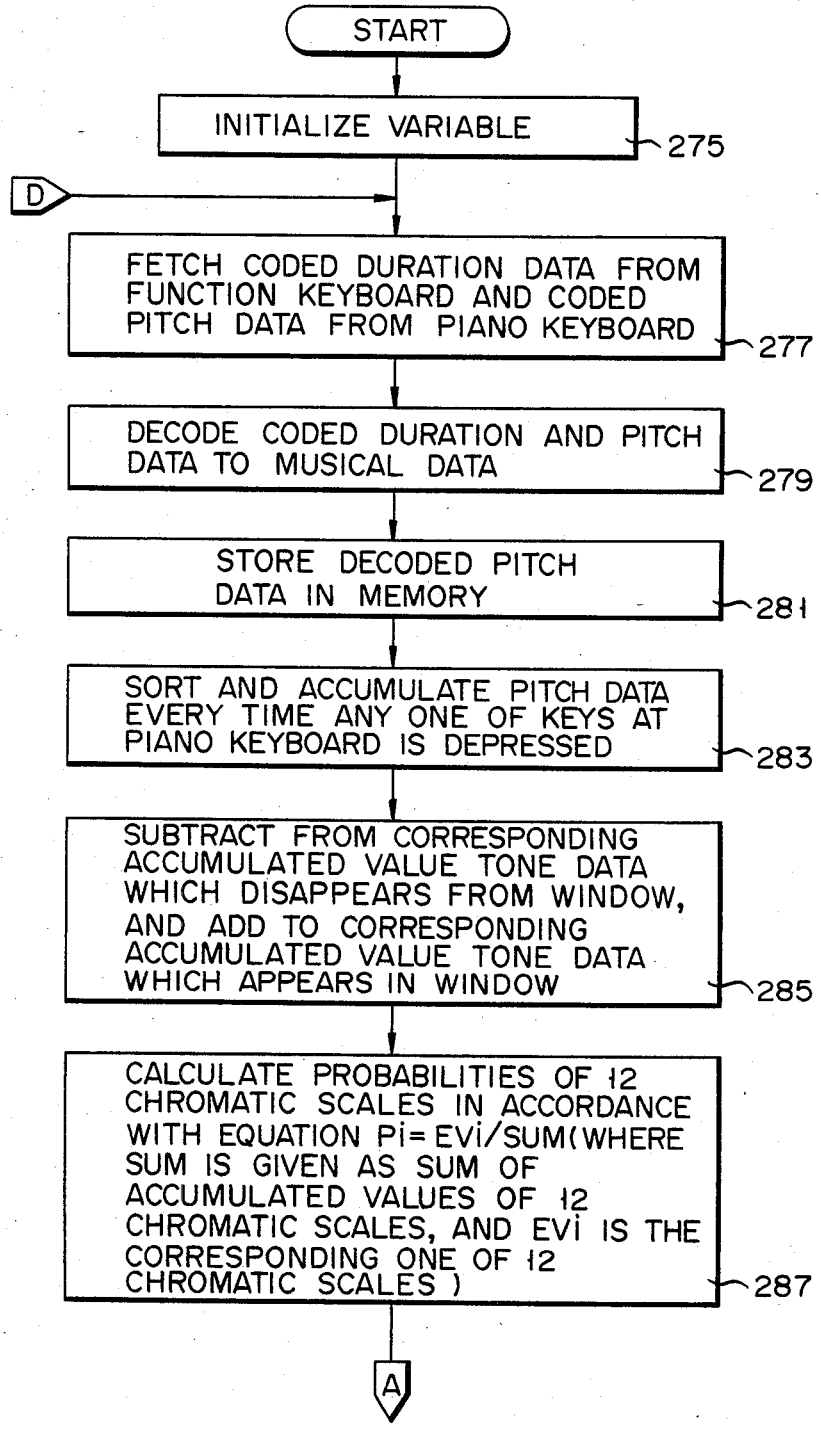
FIGS. 5A to 5D are respectively flow charts for explaining a note data input sequence and an operation for determining an accidental and tonality in accordance with the entropy calculation.
Figure 5B:
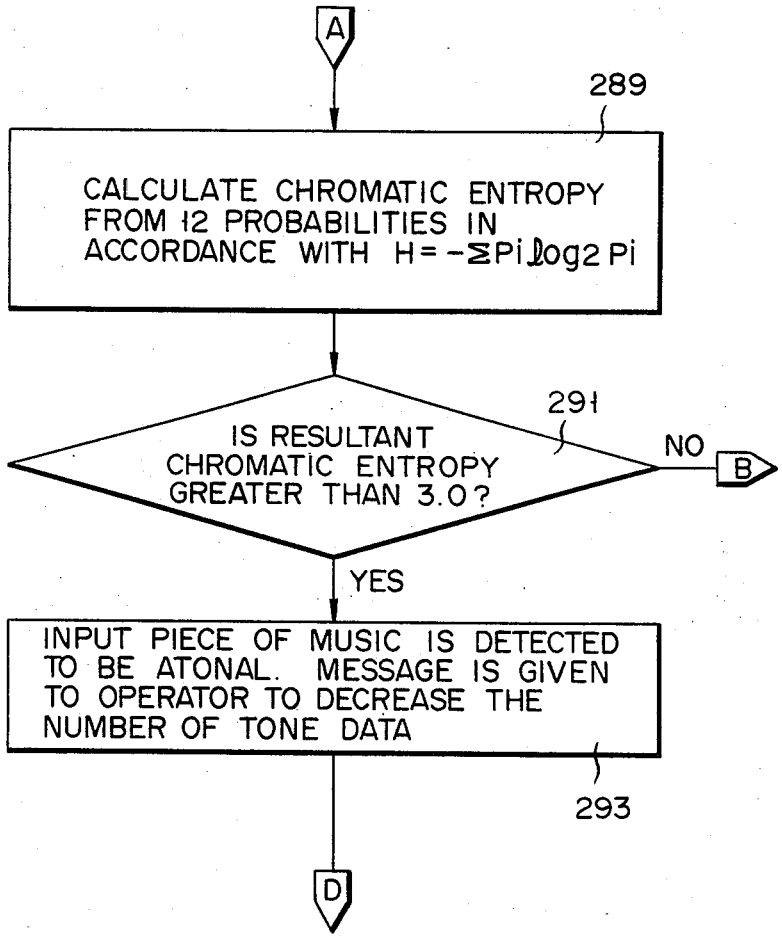
Figure 5C:
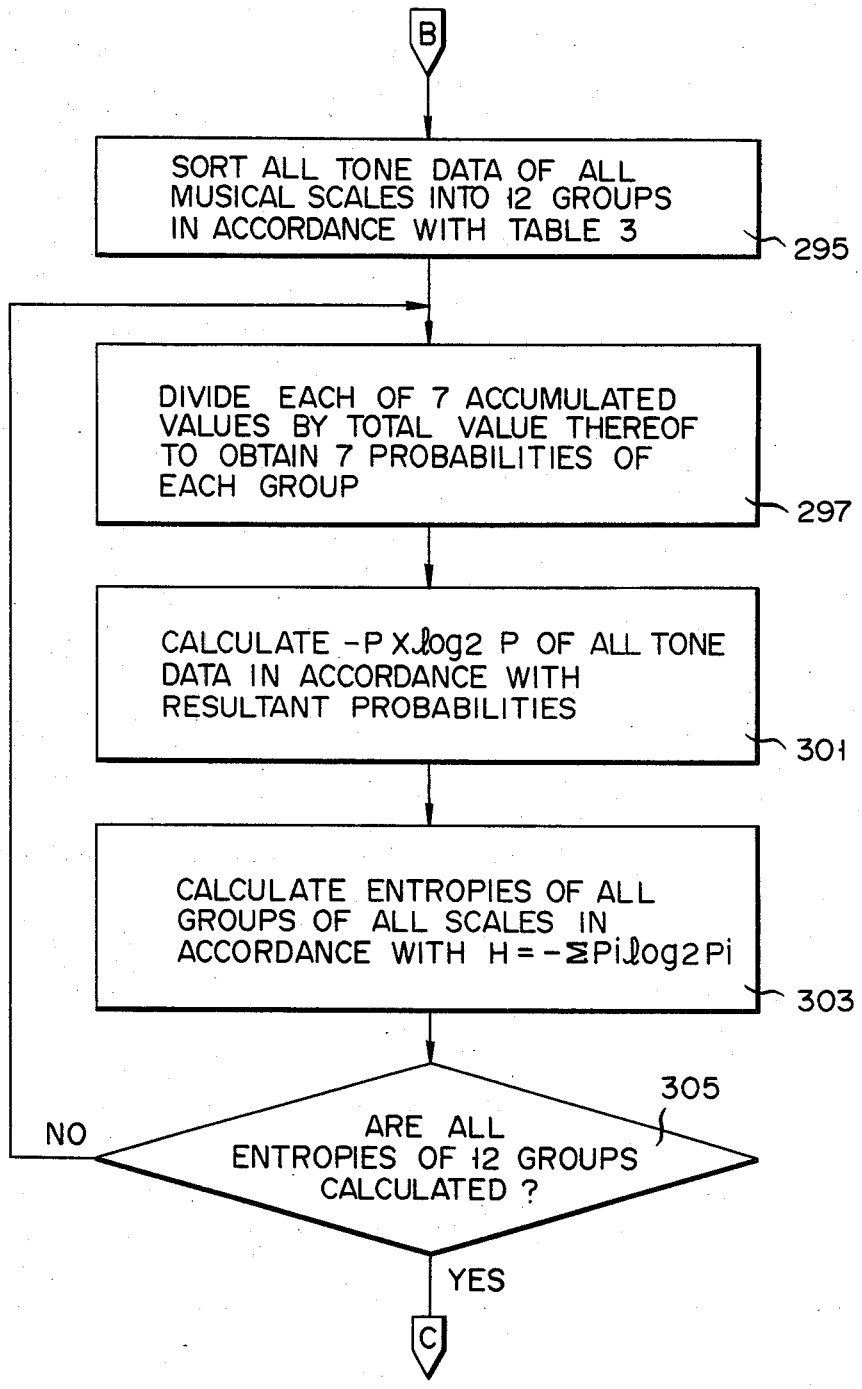
Figure 5D:
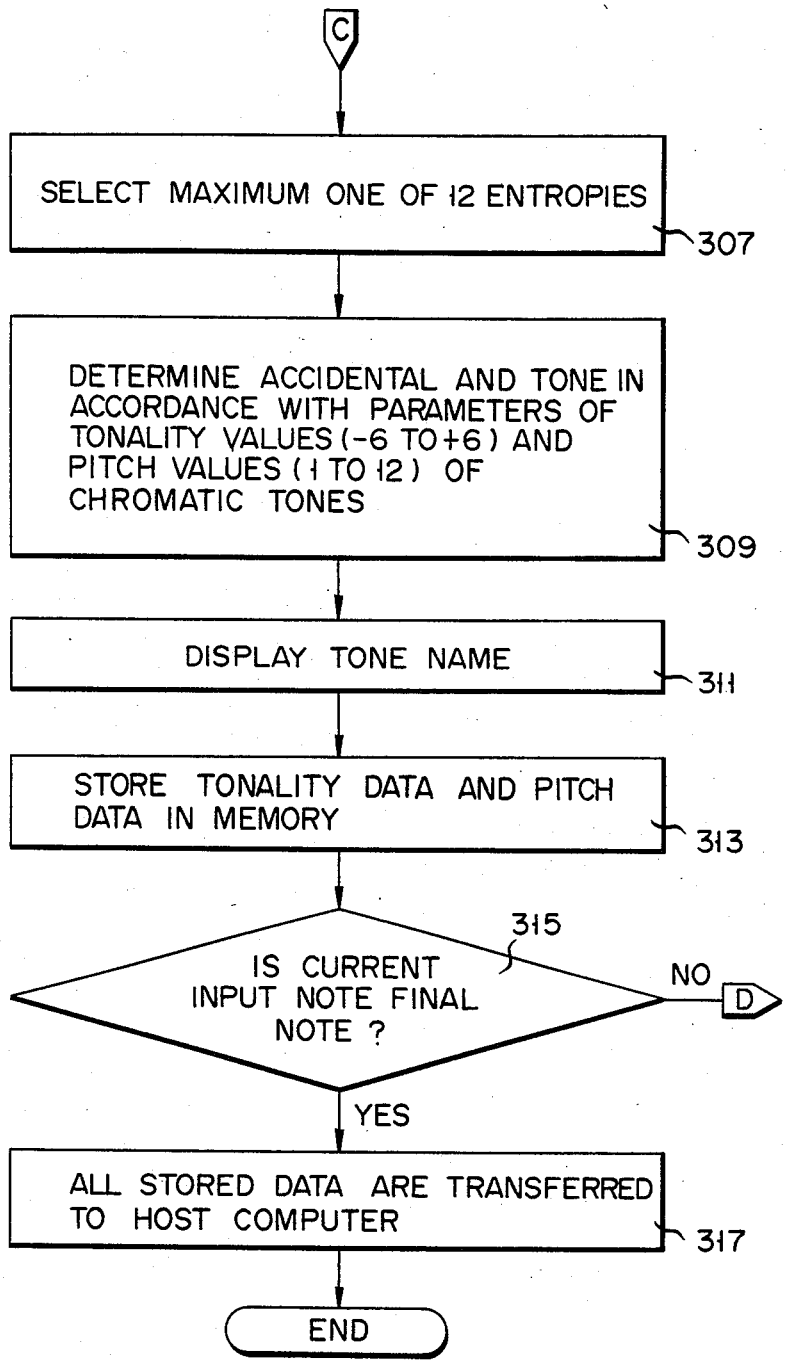
Figure 6:
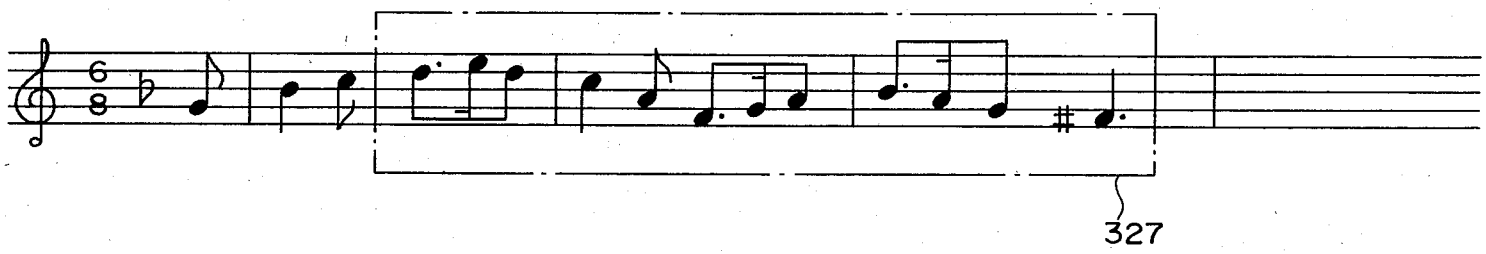
FIG. 6 is a representation for explaining a window.

In step 275 in FIG. 5A, a variable corresponding to the number of note data included in the block 327 is initialized. In step 277, the CPU 5 fetches coded duration data supplied from the function keyboard 11 and the coded pitch data supplied from the piano keyboard 1. In step 279, the CPU 5 decodes the duration and pitch data to digital musical data. The decoded data are stored in the memory 9 in step 281. The CPU 5 then performs the operation of step 283. In step 283, every time any one of the keys at the piano keyboard 1 is depressed, the note data is classified and counted.

TABLE 6

| | | | | | | | | | | | | |
|---|---|---|---|---|---|---|---|---|---|---|---|---|
| Counter (memory) | 3 | 1 | 0 | 1 | 0 | 2 | 0 | 1 | 1 | 1 | 2 | 0 |
| Chromatic Scale | A | B♭ | B | C | C♯ | D | E♭ | E | F | F♯ | G | G♯ |
| | 1 | 2 | 3 | 4 | 5 | 6 | 7 | 8 | 9 | 10 | 11 | 12 |
| Probability | 3/12 | 1/12 | 0 | 1/12 | 0 | 2/12 | 0 | 1/12 | 1/12 | 1/12 | 2/12 | 0 |
| $-P \times \log_2 P$ | 0.50 | 0.30 | | 0.30 | | 0.43 | | 0.30 | 0.30 | 0.30 | 0.43 | |
| Entropy | $H = -\Sigma Pi\log_2 Pi = 0.50 + 0.30 + 0.30 + 0.43 + 0.30 + 0.30 + 0.30 + 0.43 = 2.86$ | | | | | | | | | | | |

In step 285, the CPU 5 decrements a counter by the number of pitch data disappearing from the window and increments the counter by the number of pitch data appearing in the window. In step 287, the CPU 5 calculates the probabilities of each of the 12 chromatic tones in accordance with the equation $Pi=EVi/SUM$ (where Pi is the probability, SUM is the sum of counts of 12 chromatic tone counters, and EVi is the content of one of the corresponding 12 chromatic tone counters). In step 289, the CPU 5 calculates chromatic scale entropy using the 12 probabilities in accordance with equation $$H = -\sum_{i=1}^{N} Pi\log_2 Pi.$$

In step 291, the CPU 5 checks whether or not the resultant chromatic scale entropy is greater than 3.0. If NO in step 291, the CPU 5 performs the operation of step 295. In step 295, the CPU 5 causes 12 different scale counters to count the seven diatonic tone data, as shown in Table 7. Table 7 actually shows 13 scale counters. However, the contents of the scale counters in Gb major/Eb minor (−6) and in F♯ major/D♯ minor (+6) can be considered to be substantially equal. Therefore, the use of 12 different scale counters are sufficient to count the data.

TABLE 7

| | | | | | | | | | | | | | |
|---|---|---|---|---|---|---|---|---|---|---|---|---|---|
| (1) | | | | | | | | | | | | | |
| C major/A minor | 3 | | 0 | 1 | | 2 | | 1 | 1 | | 2 | | = 10 |
| (0) | A | | B | C | | D | | E | F | | G | | |
| Probability | 3/10 | | 0 | 1/10 | | 2/10 | | 1/10 | 1/10 | | 2/10 | | |
| $-P \times \log_2 P$ | 0.53 | | | 0.33 | | 0.46 | | 0.33 | 0.33 | | 0.46 | | |
| Entropy | $H = -\Sigma Pi\log_2 Pi = 0.53 + 0.33 + 0.46 + 0.33 + 0.33 + 0.46 = 2.44$ | | | | | | | | | | | | |
| (2) | | | | | | | | | | | | | |
| F major/D minor | 3 | 1 | | 1 | | 2 | | 1 | 1 | | 2 | | = 11 |
| (−1) | A | B♭ | | C | | D | | E | F | | G | | |
| Probability | 3/11 | 1/11 | | 1/11 | | 2/11 | | 1/11 | 1/11 | | 2/11 | | |
| $-P \times \log_2 P$ | 0.51 | 0.31 | | 0.31 | | 0.45 | | 0.31 | 0.31 | | 0.45 | | |
| Entropy | $H = -\Sigma Pi\log_2 Pi = 0.51 + 0.31 + 0.31 + 0.45 + 0.31 + 0.31 + 0.45 = 2.65$ | | | | | | | | | | | | |
| (3) | | | | | | | | | | | | | |
| B major/G minor | 3 | 1 | | 1 | | 2 | 0 | | 1 | | 2 | | = 10 |
| (−2) | A | B♭ | | C | | D | E♭ | | F | | G | | |
| Probability | 3/10 | 1/10 | | 1/10 | | 2/10 | | | 1/10 | | 2/10 | | |
| $-P \times \log_2 P$ | 0.53 | 0.33 | | 0.33 | | 0.46 | | | 0.33 | | 0.46 | | |
| Entropy | $H = -\Sigma Pi\log_2 Pi = 0.53 + 0.33 + 0.33 + 0.46 + 0.33 + 0.46 = 2.44$ | | | | | | | | | | | | |
| (4) | | | | | | | | | | | | | |
| E♭ major/C minor | | 1 | | 1 | | 2 | 0 | | 1 | | 2 | 0 | = 7 |
| (−3) | | B♭ | | C | | D | E♭ | | F | | G | A♭ | |

TABLE 7-continued

| | | | | | | | | |
|---|---|---|---|---|---|---|---|---|
| Probability | 1/7 | 1/7 | 2/7 | 0 | 1/7 | 2/7 | 0 | |
| $-P \times \log_2 P$ | 0.40 | 0.40 | 0.50 | | 0.40 | 0.50 | | |
| Entropy | $H = -\Sigma P i \log_2 P i = 0.40 + 0.40 + 0.50 + 0.40 + 0.50 = 2.2$ | | | | | | | |
| (5) | | | | | | | | |
| A♭ major/F minor | 1 | 1 | 0 | 0 | 1 | 2 | 0 | = 5 |
| (−4) | B♭ | C | D♭ | E♭ | F | G | A♭ | |
| Probability | 1/5 | 1/5 | 0 | 0 | 1/5 | 2/5 | 0 | |
| $-P \times \log_2 P$ | 0.46 | 0.46 | | | 0.46 | 0.53 | | |
| Entropy | $H = -\Sigma P i \log_2 P i = 0.46 + 0.46 + 0.46 + 0.53 = 1.91$ | | | | | | | |
| (6) | | | | | | | | |
| D♭ major/B♭ minor | 1 | 1 | 0 | 0 | 1 | 0 | 0 | = 3 |
| (−5) | B♭ | C | D♭ | E♭ | F | G♭ | A♭ | |
| Probability | 1/3 | 1/3 | 0 | 0 | 1/3 | 0 | 0 | |
| $-P \times \log_2 P$ | 0.52 | 0.52 | | | 0.52 | | | |
| Entropy | $H = -\Sigma P i \log_2 P i = 0.52 + 0.52 + 0.52 = 1.56$ | | | | | | | |
| (7) | | | | | | | | |
| G♭ major/E♭ minor | 1 | 0 | 0 | 0 | 1 | 0 | 0 | = 2 |
| (−6) | B♭ | C♭ | D♭ | E♭ | F | G♭ | A♭ | |
| Probability | 1/2 | 0 | 0 | 0 | 1/2 | 0 | 0 | |
| $-P \times \log_2 P$ | 0.5 | 0 | 0 | 0 | 0.5 | 0 | 0 | |
| Entropy | $H = -\Sigma P i \log_2 P i = 0.5 + 0.5 = 1.0$ | | | | | | | |
| (8) | | | | | | | | |
| G major/A minor | 3 | 0 | 1 | 2 | 1 | 1 | 2 | = 9 |
| (+1) | A | B | C | D | E | F# | G | |
| Probability | 3/9 | 0 | 1/9 | 2/9 | 1/9 | 1/9 | 2/9 | |
| $-P \times \log_2 P$ | 0.53 | 0 | 0.35 | 0.48 | 0.35 | 0.35 | 0.48 | |
| Entropy | $H = -\Sigma P i \log_2 P i = 0.53 + 0.35 + 0.48 + 0.35 + 0.35 + 0.48 = 2.54$ | | | | | | | |
| (9) | | | | | | | | |
| D major/B minor | 3 | 0 | 0 | 2 | 1 | 1 | 2 | = 8 |
| (+2) | A | B | C# | D | E | F# | G | |
| Probability | 3/8 | 0 | 0 | 2/8 | 1/8 | 1/8 | 2/8 | |
| $-P \times \log_2 P$ | 0.53 | 0 | 0 | 0.50 | 0.38 | 0.38 | 0.50 | |
| Entropy | $H = -\Sigma P i \log_2 P i = 0.53 + 0.50 + 0.38 + 0.38 + 0.50 = 2.29$ | | | | | | | |
| (10) | | | | | | | | |
| A major/F# minor | 3 | 0 | 0 | 2 | 1 | 1 | 0 | = 7 |
| (+3) | A | B | C# | D | E | F# | G# | |
| Probability | 3/7 | 0 | 0 | 2/7 | 1/7 | 1/7 | 0 | |
| $-P \times \log_2 P$ | 0.52 | 0 | 0 | 0.52 | 0.40 | 0.40 | 0 | |
| Entropy | $H = -\Sigma P i \log_2 P i = 0.52 + 0.52 + 0.40 + 0.40 = 1.84$ | | | | | | | |
| (11) | | | | | | | | |
| E major/C# minor | 3 | 0 | 0 | 0 | 1 | 1 | 0 | = 5 |
| (+4) | A | B | C# | D# | E | F# | G# | |
| Probability | 3/5 | 0 | 0 | 0 | 1/5 | 1/5 | 0 | |
| $-P \times \log_2 P$ | 0.44 | 0 | 0 | 0 | 0.46 | 0.46 | 0 | |
| Entropy | $H = -\Sigma P i \log_2 P i = 0.44 + 0.46 + 0.46 = 1.36$ | | | | | | | |
| (12) | | | | | | | | |
| B major/G# minor | 0 | 0 | 0 | 0 | 1 | 1 | 0 | = 2 |
| (+5) | A# | B | C# | D# | E | F# | G# | |
| Probability | 0 | 0 | 0 | 0 | 1/2 | 1/2 | 0 | |
| $-P \times \log_2 P$ | 0 | 0 | 0 | 0 | 0.5 | 0.5 | 0 | |
| Entropy | $H = -\Sigma P i \log_2 P i = 0.5 + 0.5 = 1.0$ | | | | | | | |
| (13) | | | | | | | | |
| F# major/D# minor | 0 | 0 | 0 | 0 | 0 | 1 | 0 | = 1 |
| (+6) | A# | B | C# | D# | E# | F# | G# | |
| Probability | 0 | 0 | 0 | 0 | 0 | 1/1 | 0 | |
| $-P \times \log_2 P$ | 0 | 0 | 0 | 0 | 0 | 0 | 0 | |
| Entropy | $H = -\Sigma P i \log_2 P i = 0$ | | | | | | | |

In step 297, the CPU 5 divides the respective counts by a total count so as to obtain seven probabilities. In step 301, the CPU 5 performs the operation of $-P \times \log_2 P$ for each probability. In step 303, the entropies of the respective products are calculated in accordance with the equation $$H = -\sum_{i=1}^{N} Pi \log_2 Pi.$$

In step 305, the CPU 5 calculates the entropies of each of the 12 different scales. However, when the 12-scale entropies have not been calculated, the flow returns to step 297. The CPU 5 repeats the sequence between steps 297 and 303. However, when the 12-scale entropies have been calculated, the CPU 5 advances to step 307. The CPU 5 selects the maximum entropy among the 12 entropies and one of the numeric values −6 to +6 representing tonality in step 307. The CPU 5 then advances to step 309. In step 309, the CPU 5 determines an accidental and a tone, with reference to Table 4, using as parameters a tonality value (one of −6 to +6) and a chromatic tone pitch (one of 1 to 12). In step 311, the CPU 5 transfers the tone data to the display unit 13, so that the tone data is displayed thereon.

In step 313, the CPU 5 stores tonality data and pitch data in the memory. The CPU 5 checks whether or not the currently input note data is the last note. If YES in step 315, the CPU 5 performs the operation of step 317 wherein all the stored data are transferred to the host computer 19.

However, if NO in step 315, the CPU 5 returns to step 277. The CPU 5 repeates the operations of steps 277 to 315.

On the other hand, if YES in step 291, the input data are determined as atonal tone in step 293. As a result, the CPU 5 insctructs to narrow the window. The CPU 5 also guides for tonality input.

Figure 7:
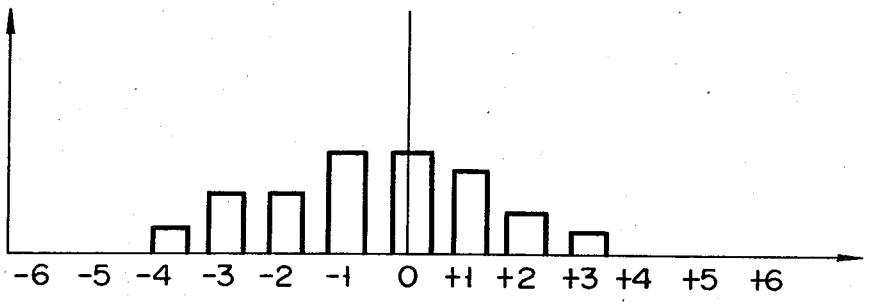
FIG. 7 is a graph for determining tonality.
Figure 8:
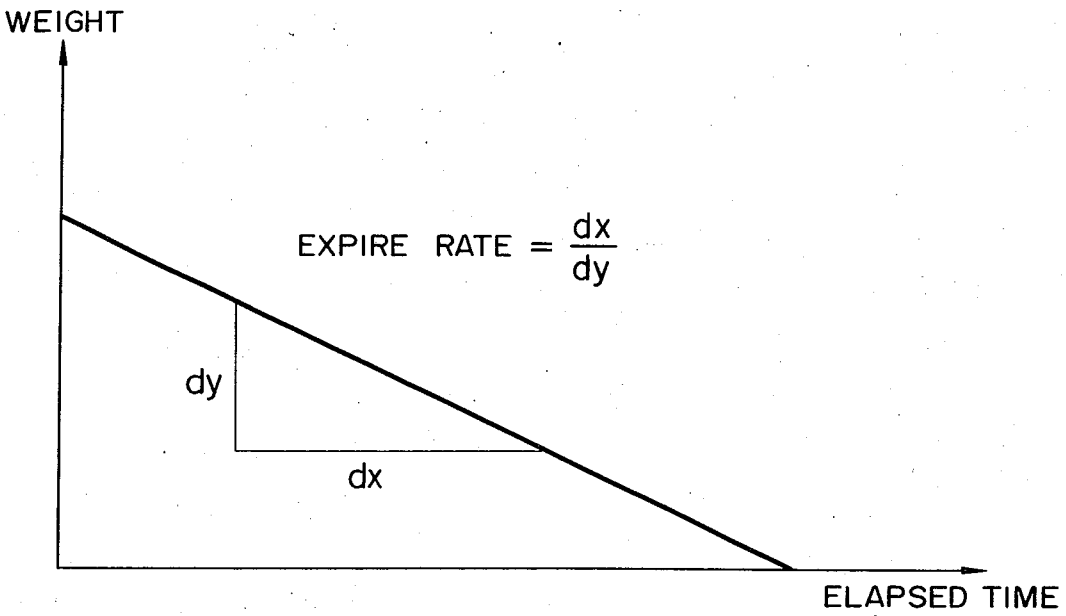
FIG. 8 is a graph for explaining an expire rate.

When at least two entropies are substantially equal to each other, a middle value is calculated in accordance with the tonality entropy distribution. As shown in FIG. 7, the middle value is used to select tonality input.

However, as in this case, if two middle values are present, the tonality input suitable for a given piece of music cannot be determined. There are two reasons for this. First, a given measure is atonal or substantially atonal, as previously described. Second, only a few tones among seven tones are used at the beginning of measures. In general, when only a few tones are used and have a weak relationship with respect to tonality, tonality determination is performed with low reliability. For example, when the tones C, F, and G are present, tonality values −4, −3, −2, −1, and 0 can be attributed to a melody consisting of the tones C, F, and G. In this case, these tones are common in keys given by tonality values −4, −3, −2, −1, and 0.

In the method of determining the corresponding accidental and tone, the number of input note data is preset, these notes are classified, and entropies of the respective notes are accumulated. However, entropy calculation is not limited to this method. An expire rate may be preset as a weighting coefficient. In this case, the predetermined expire rate is multiplied by the respective input data so as to calculate the corresponding entropy. The expire rate is defined as dx/dy when the weighting coefficient is plotted along the axis of ordinate and time is plotted along the axis of abscissa.

Figure 9:
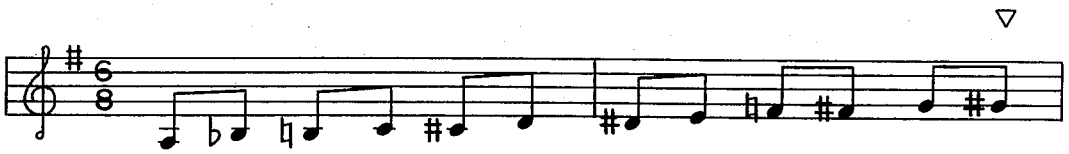
FIG. 9 is a representation showing an atonal piece of music.
Figure 10:
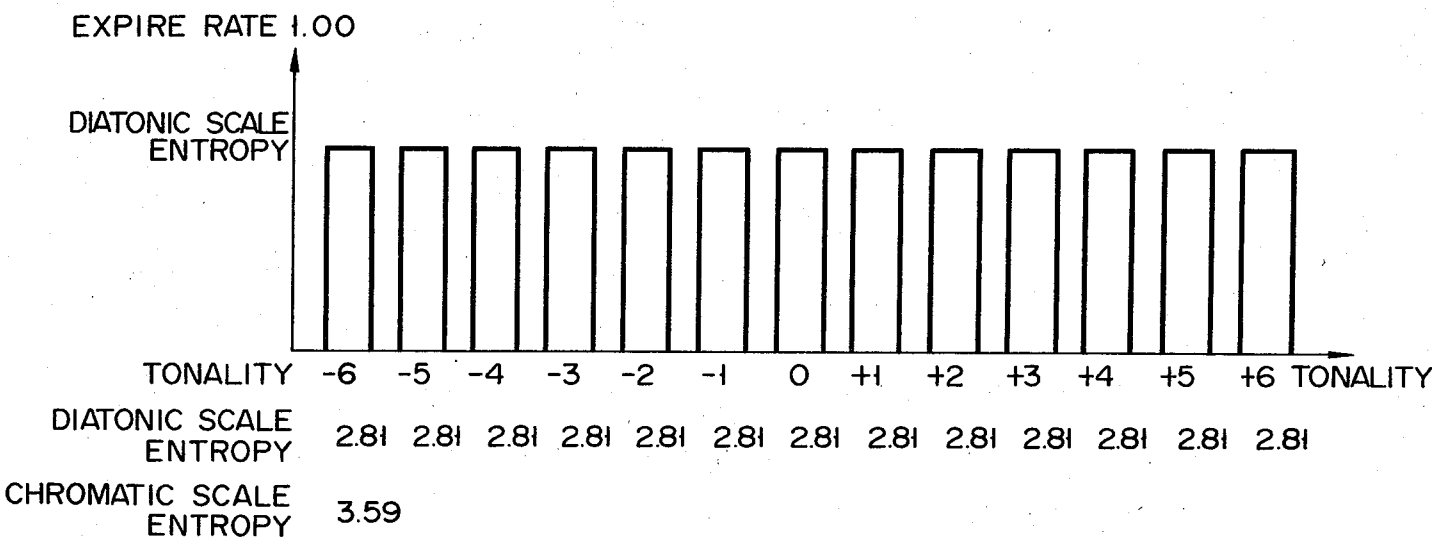
FIG. 10 is a graph showing entropy distribution as a function of tonality when the expire rate of a given piece of music is given to be 1.00.
Figure 11:
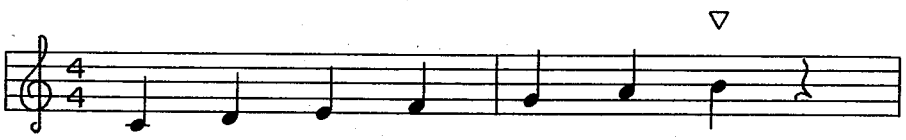
FIG. 11 is a representation showing another piece of music.
Figure 12:
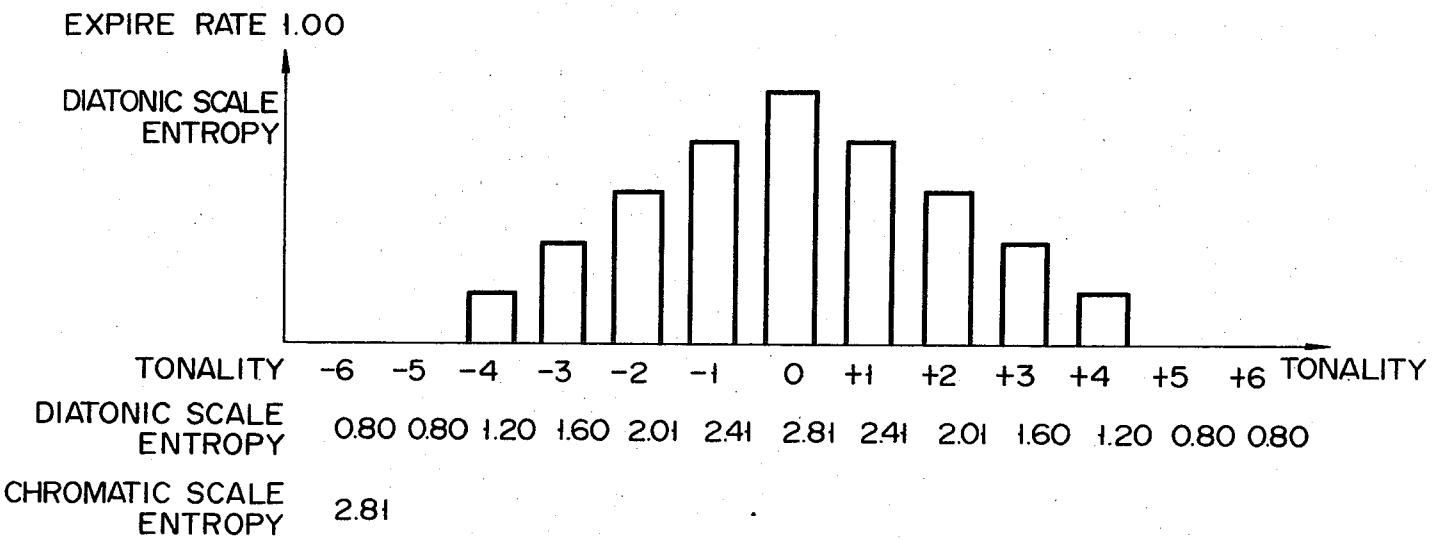
FIG. 12 is a graph showing entropy distribution as a function of tonality when the expire rate of the piece of music shown in FIG. 11 is given to be 1.00.
Figure 13:
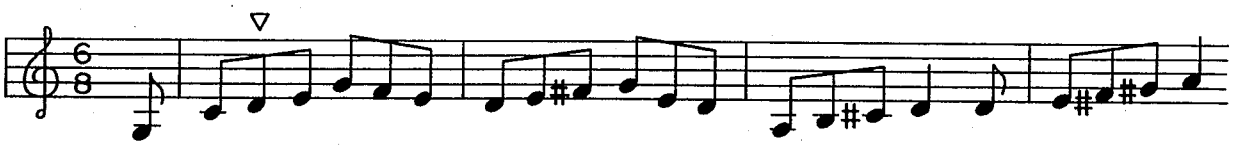
FIG. 13 is a representation showing still another piece of music.
Figure 14:
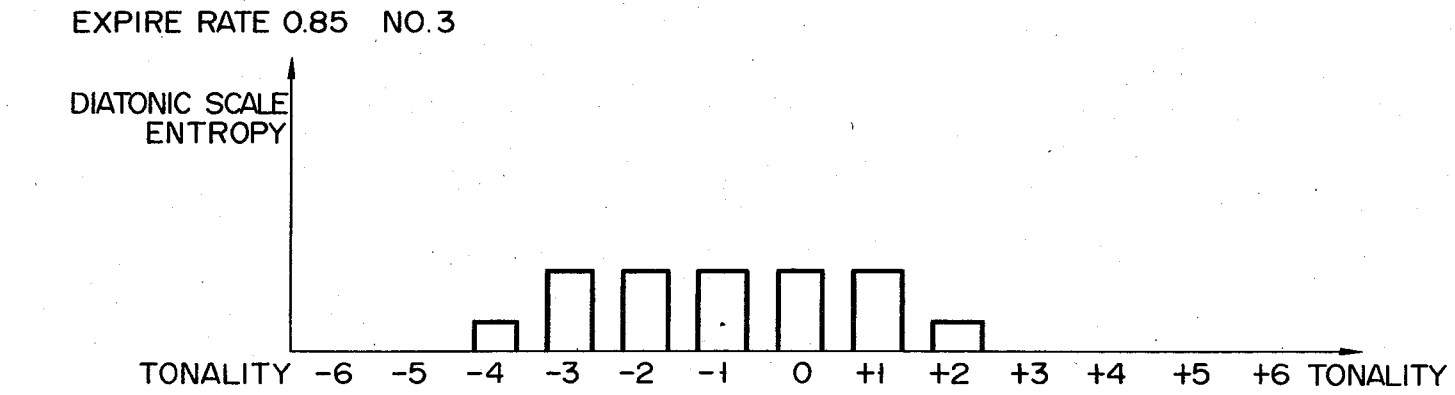
FIGS. 14 to 33 are respectively graphs showing entropy distributions as a function of tonality when entropies of the respective notes (after the fourth note in the piece of music shown in FIG. 13) at the time of data entry are calculated with an expire rate of 0.85.
Figure 15:
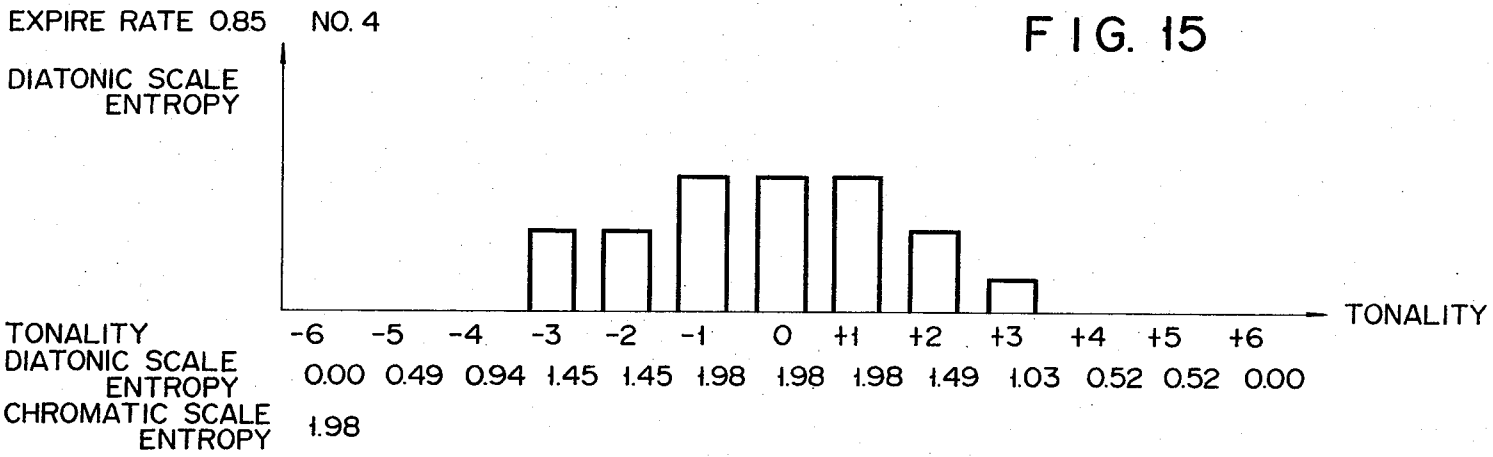
Figure 16:
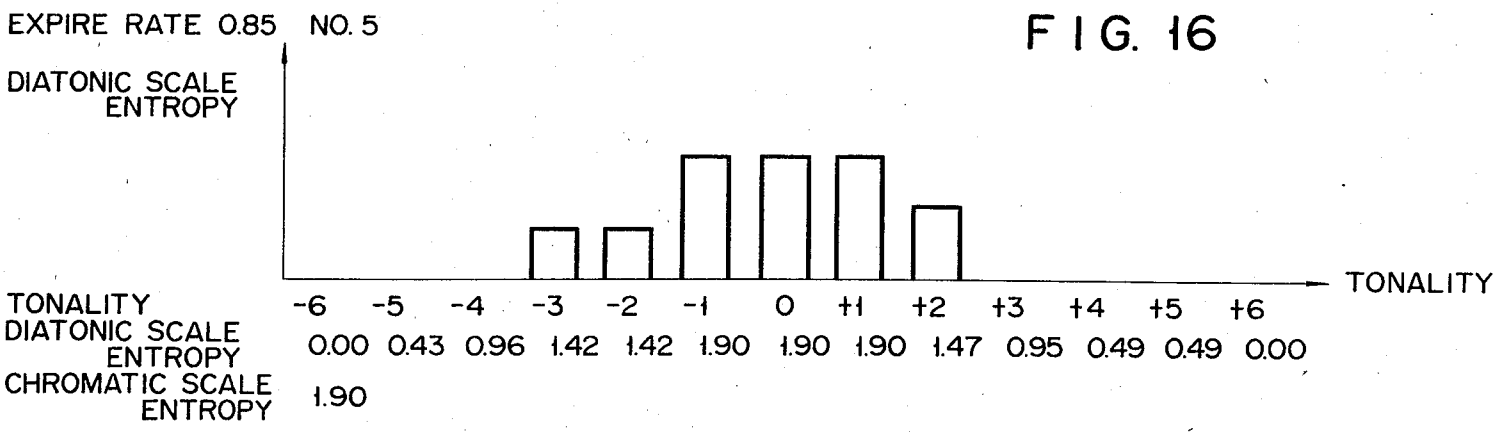
Figure 17:
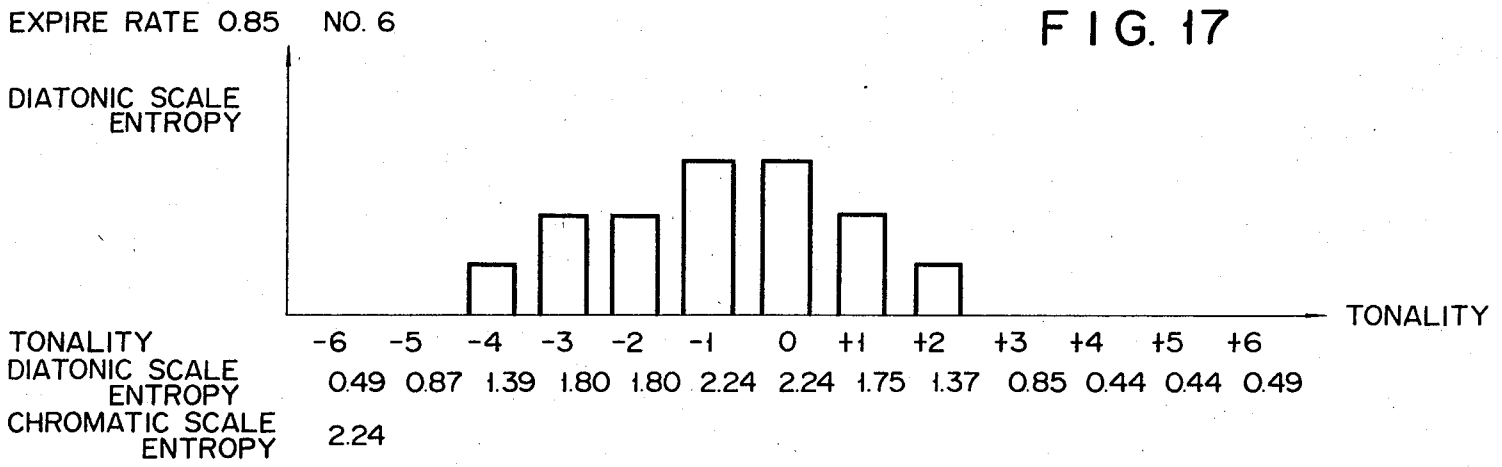
Figure 18:
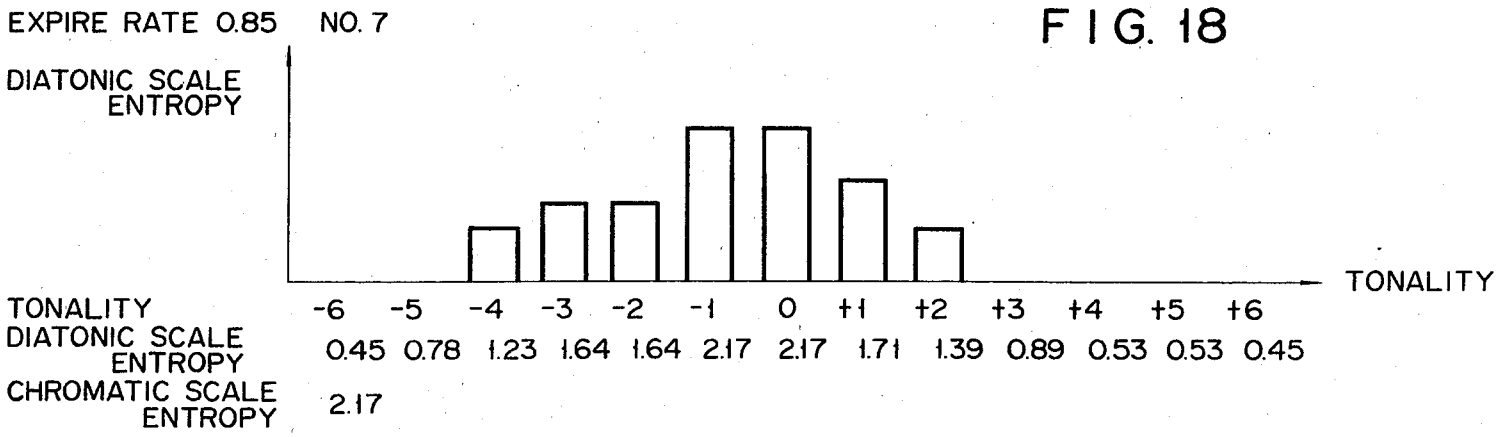
Figure 19:
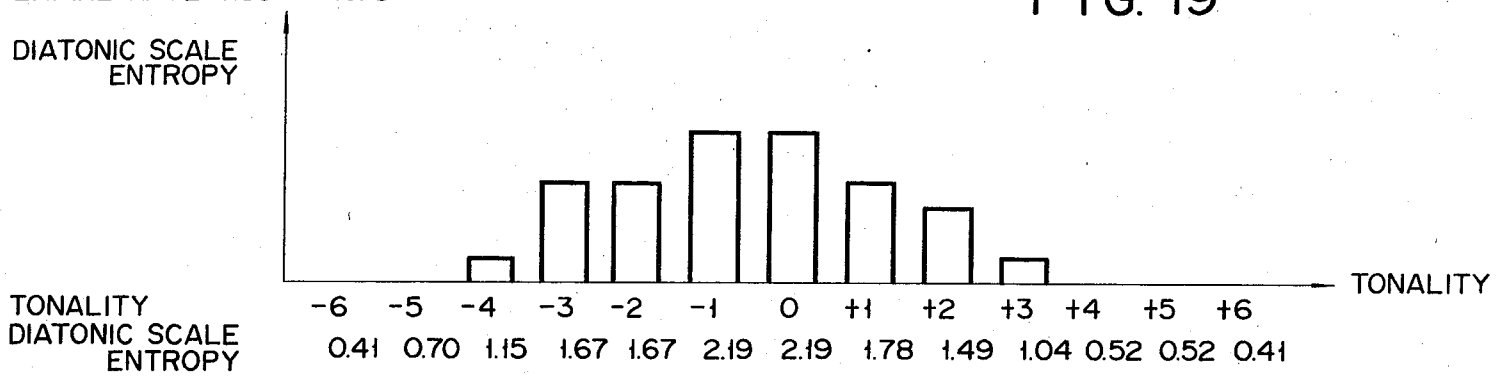
Figure 20:
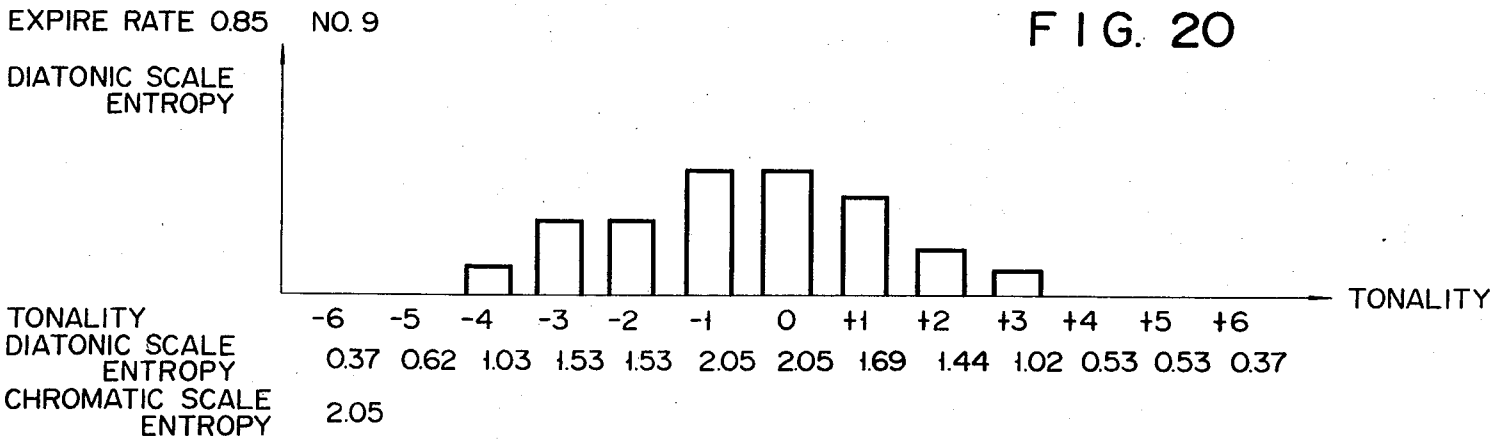
Figure 21:
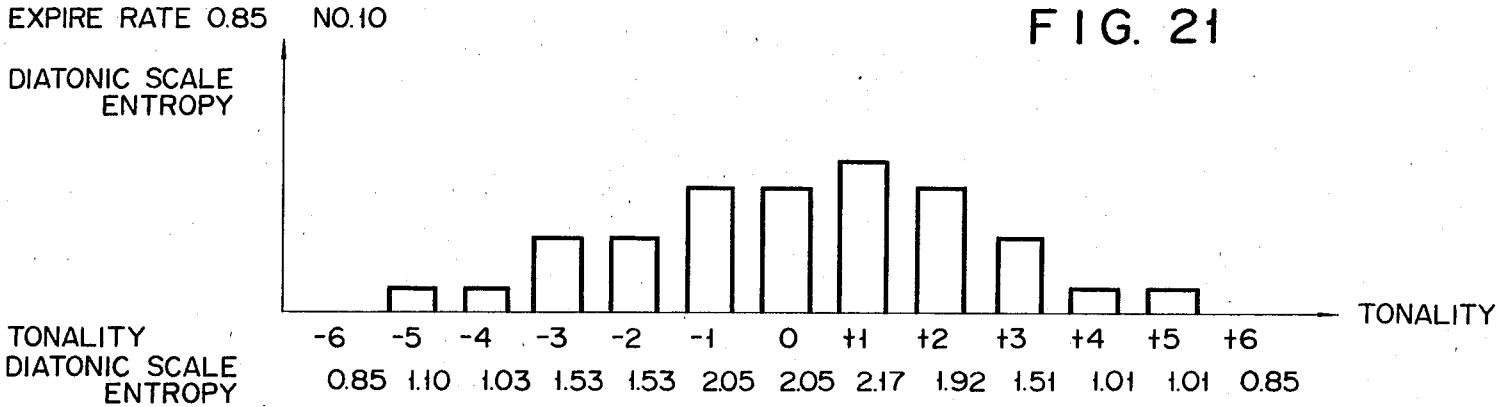
Figure 22:
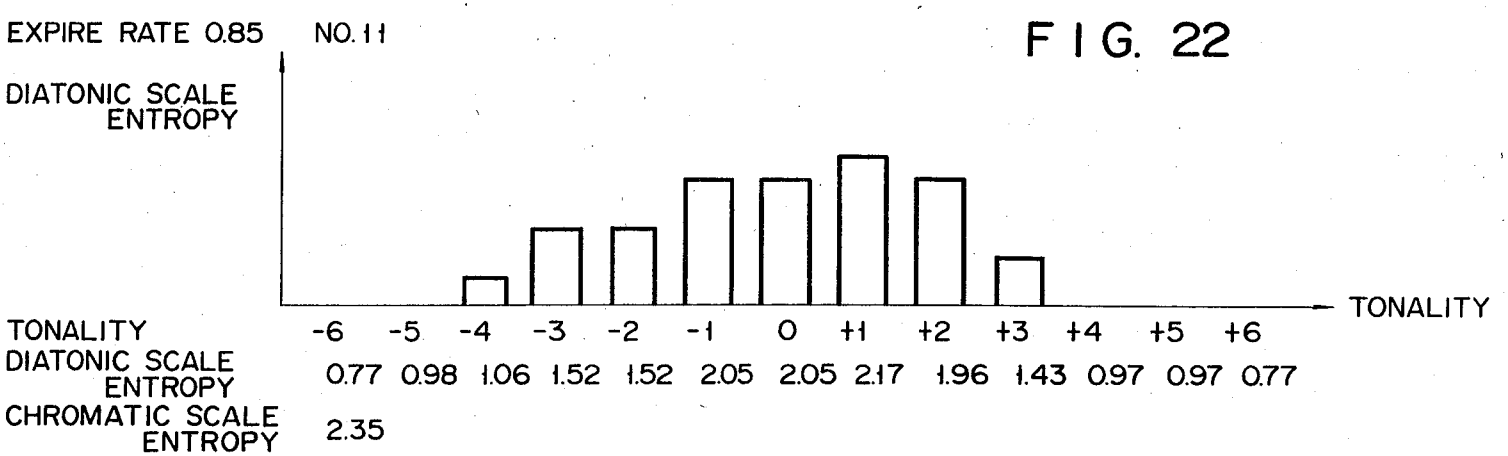
Figure 23:
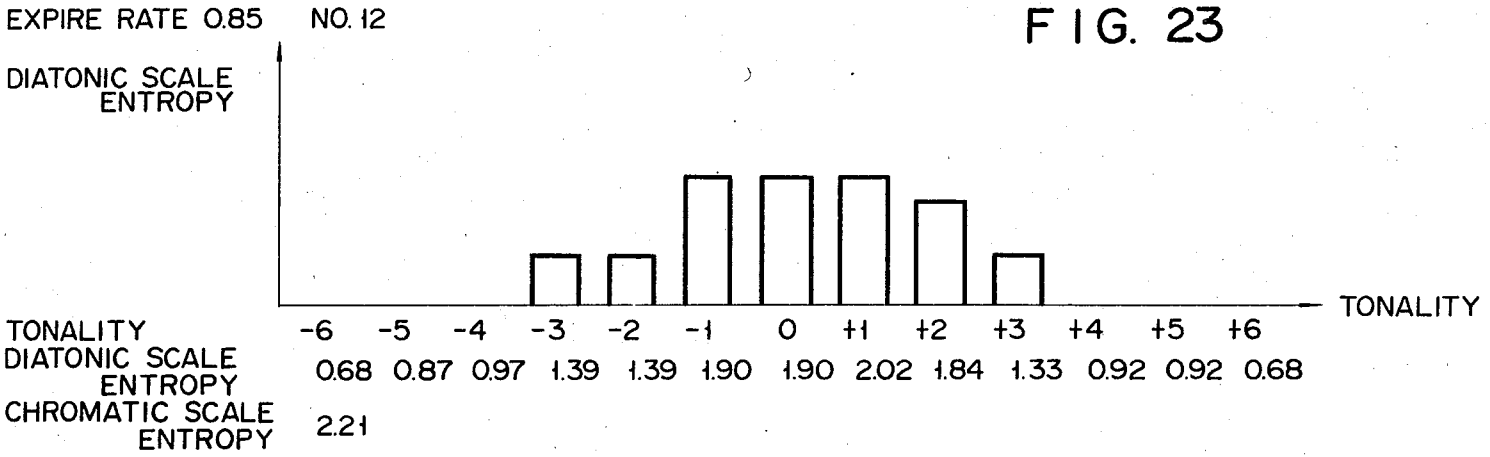
Figure 24:
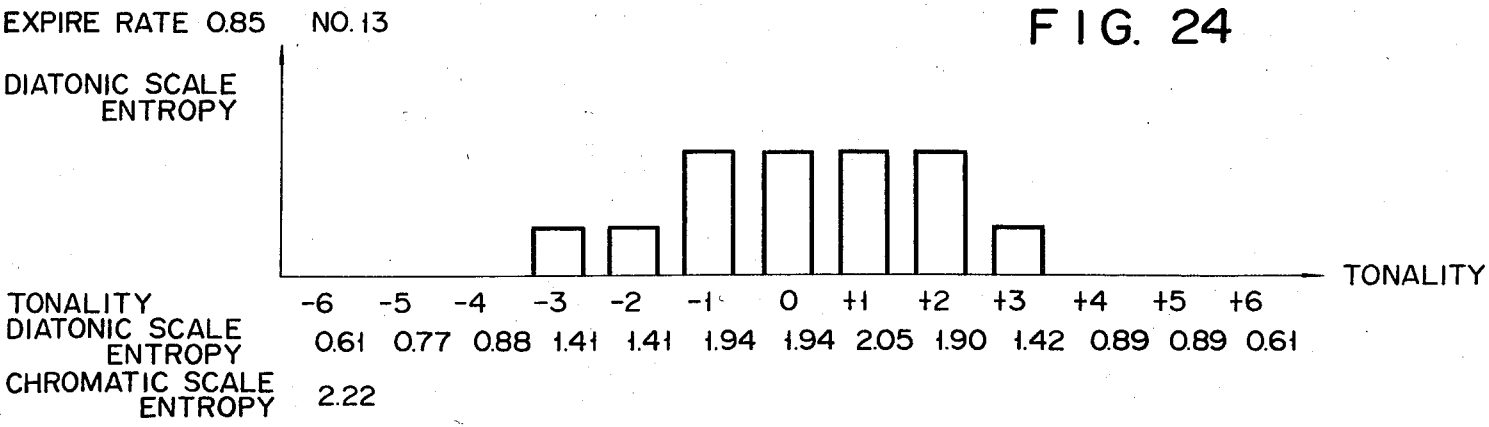
Figure 25:
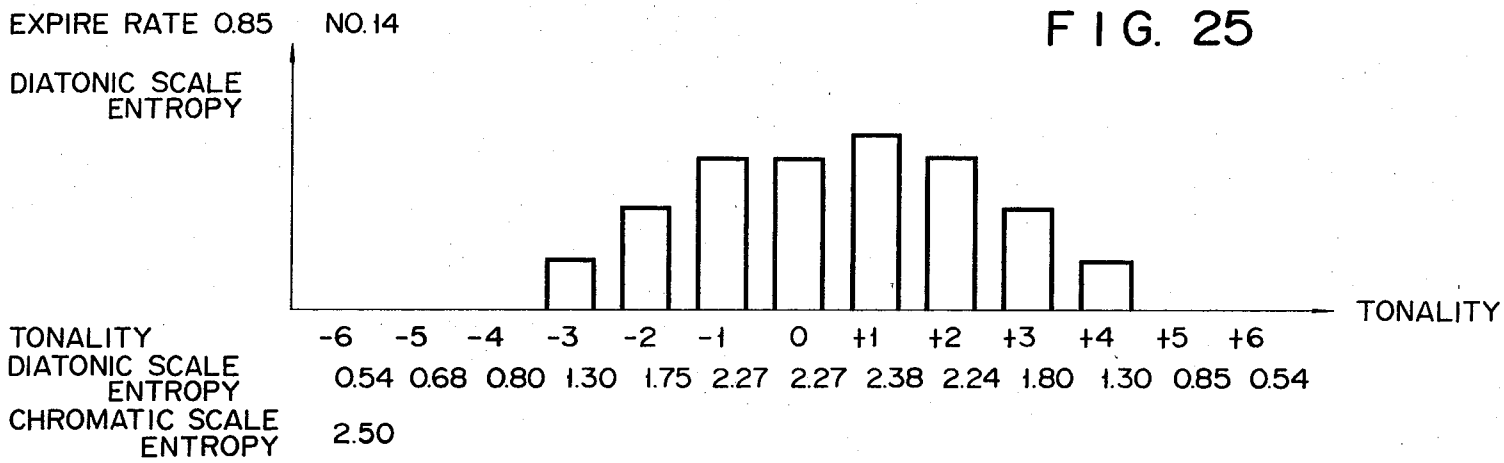
Figure 26:
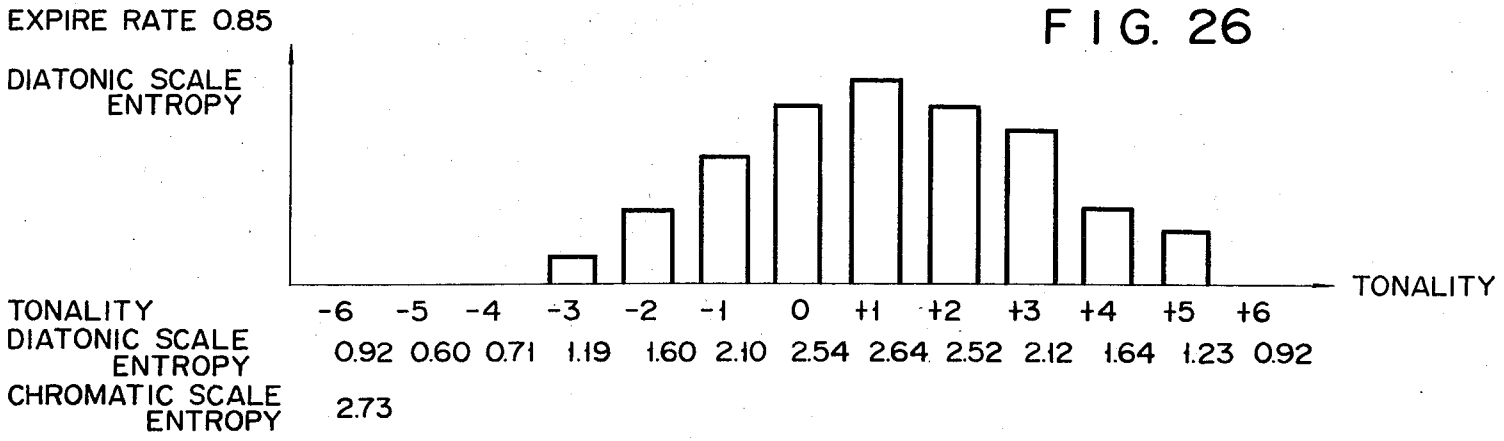
Figure 27:
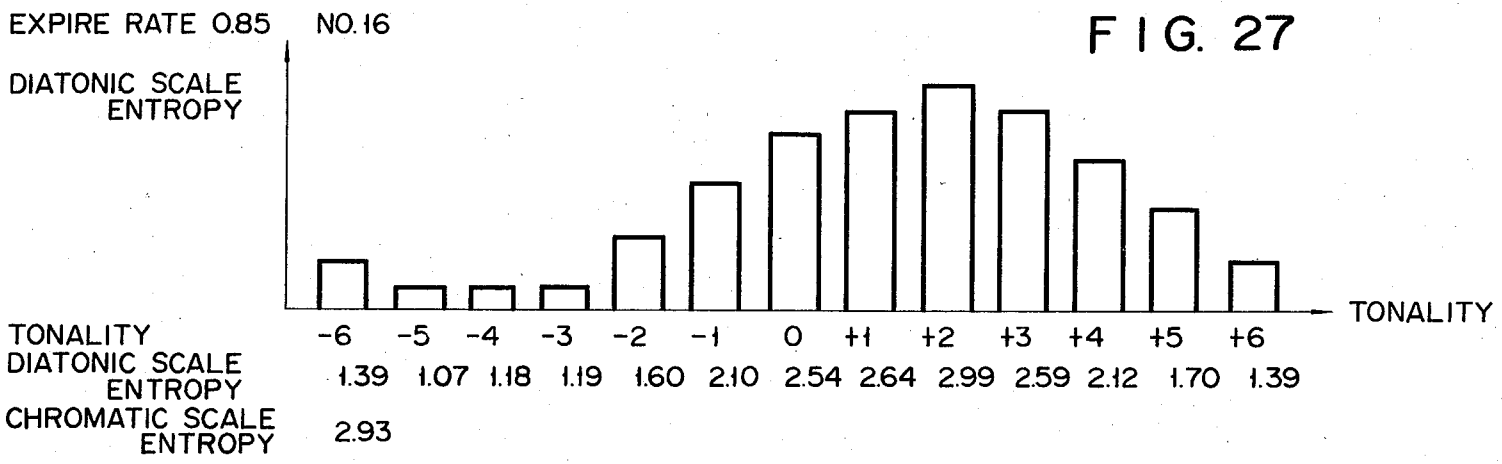
Figure 28:
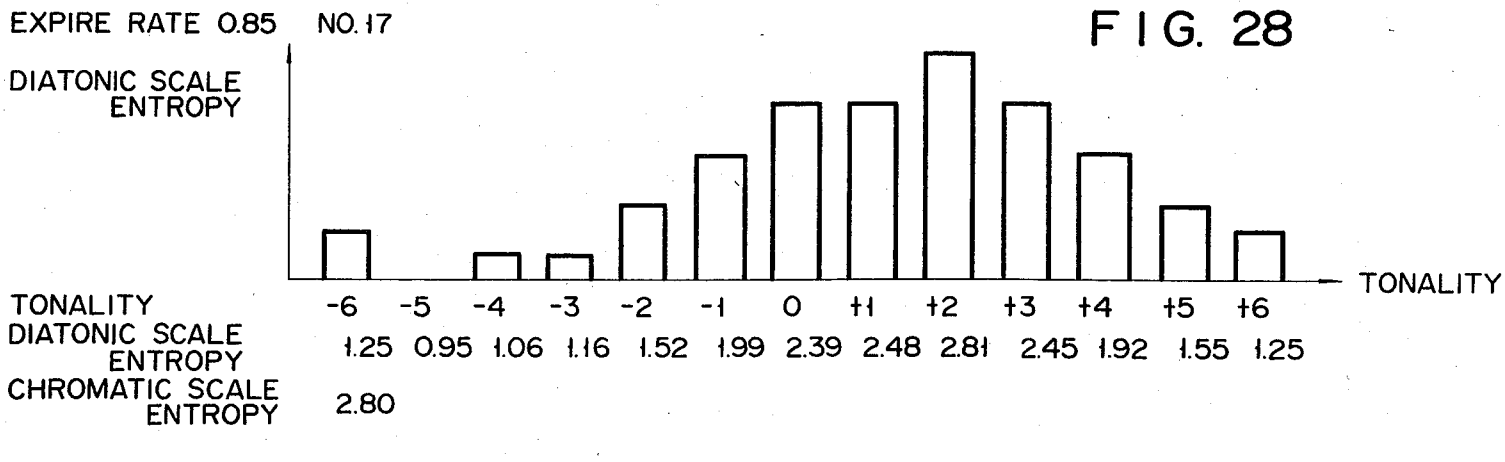
Figures 29, 30:
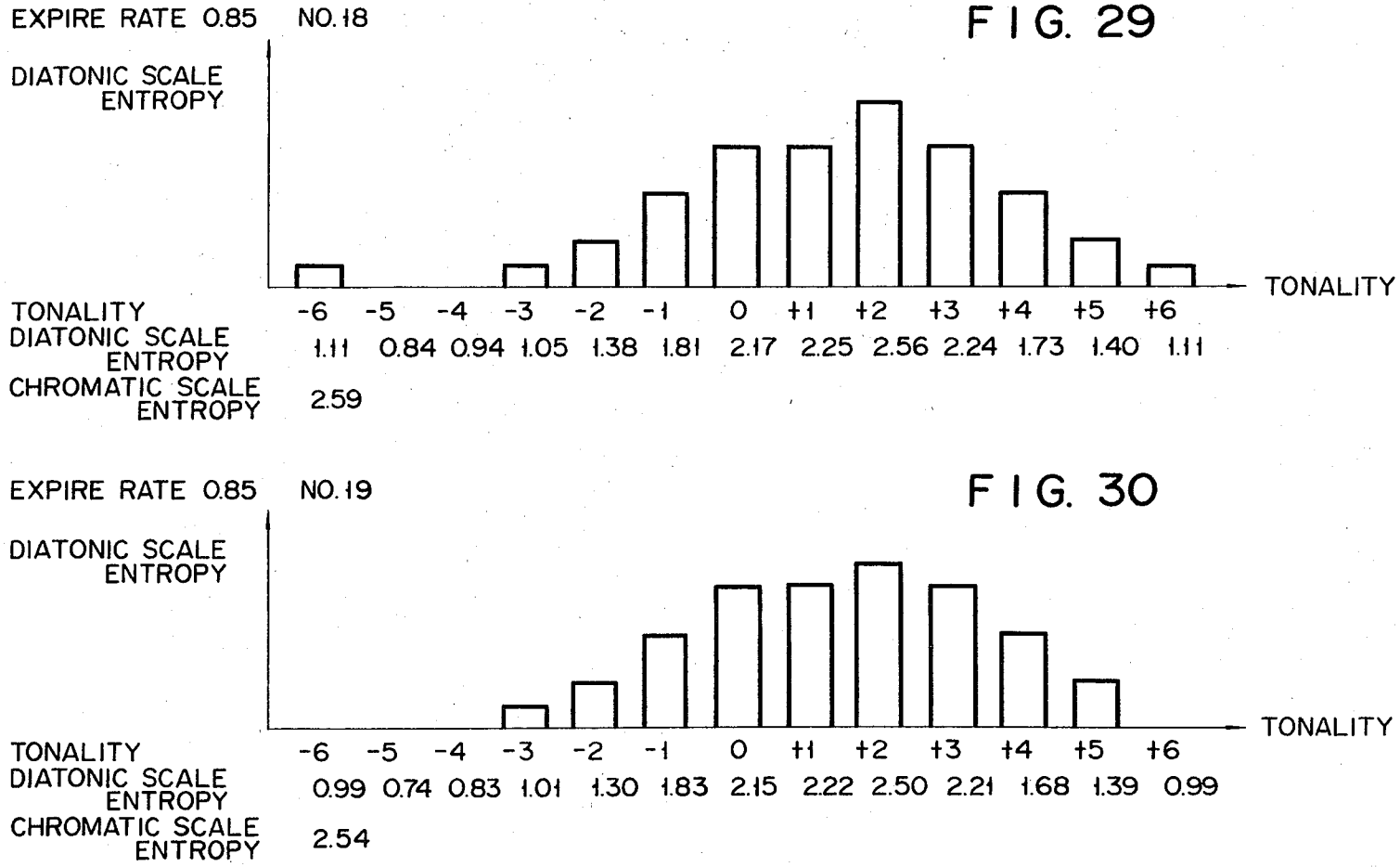
Figure 31:
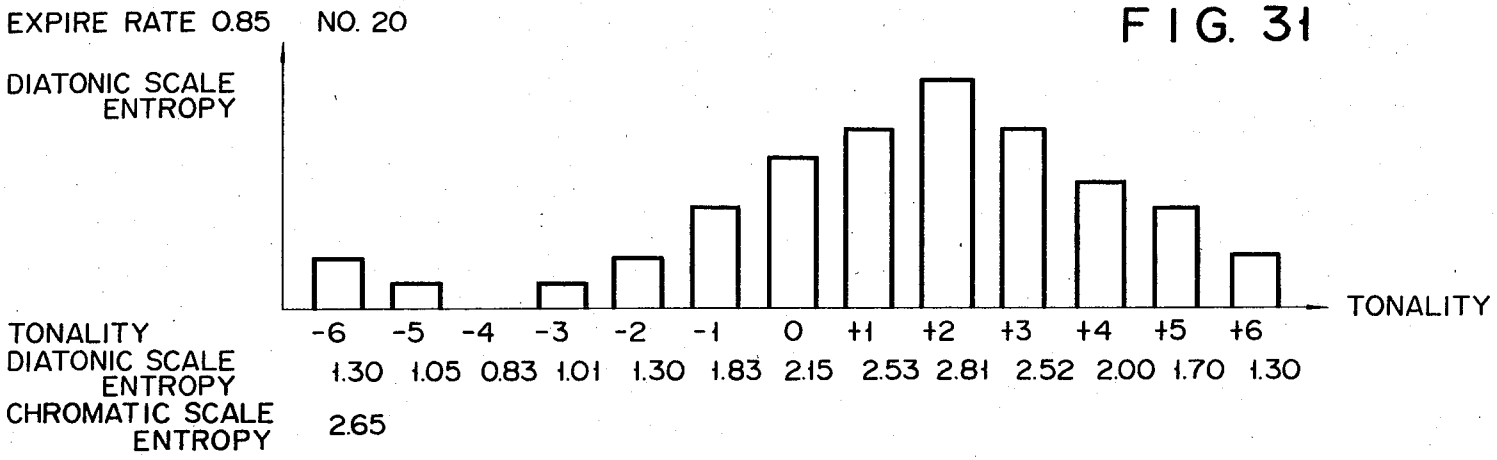
Figure 32:
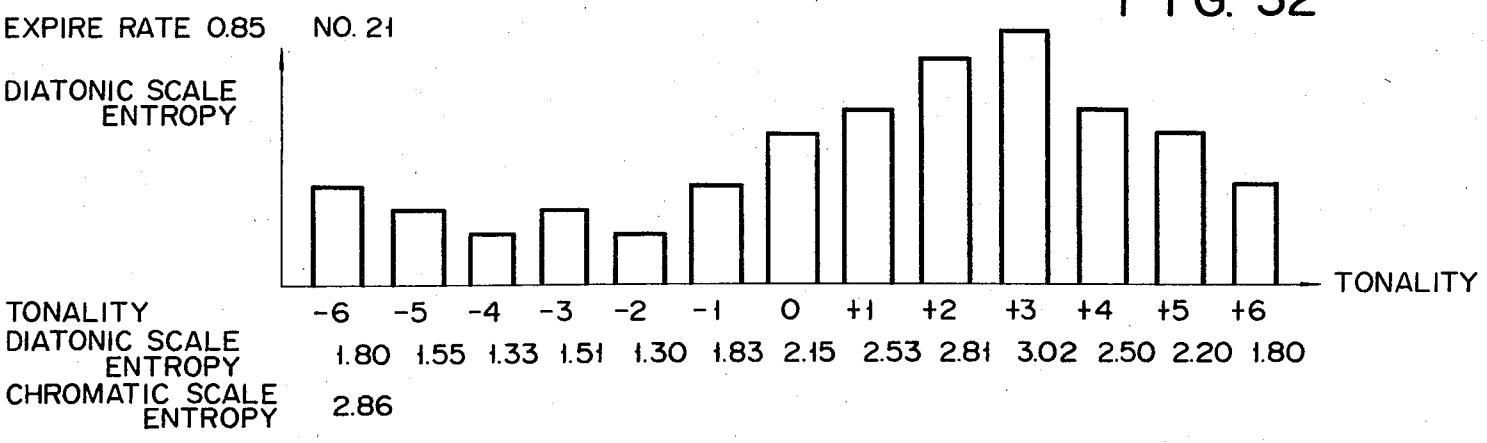
Figure 33:
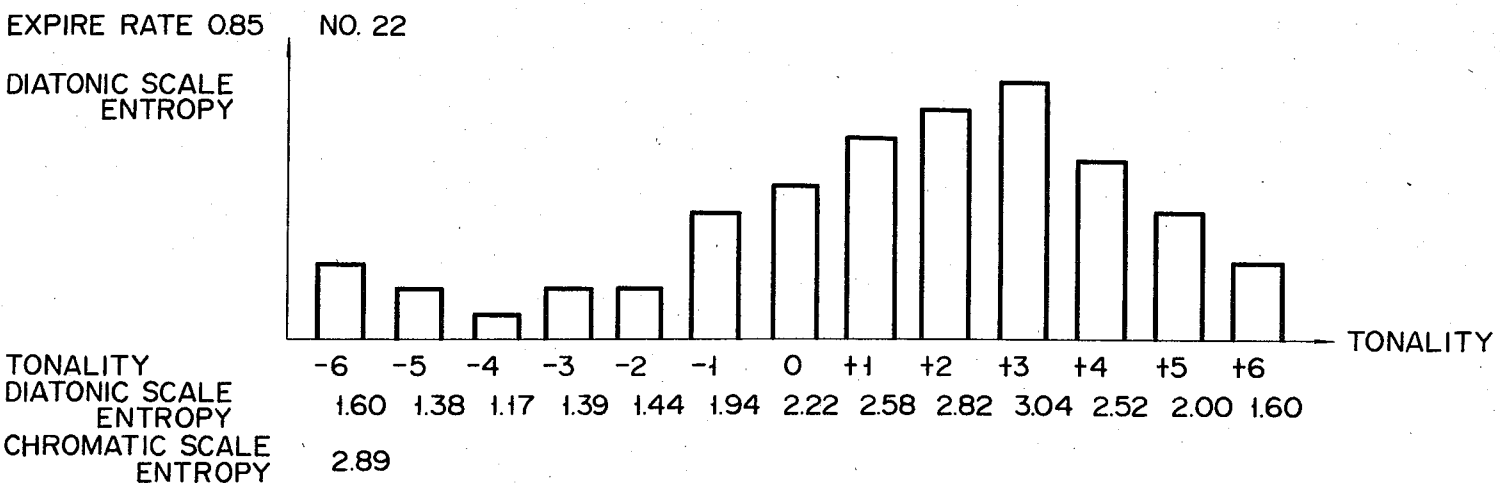

When new note data is entered, the expire rate is multiplied by the number of times the previously entered note data occurs. In this manner, the significance of the previously entered note data can be lessened. For example, when notes are sequentially entered, as shown in FIG. 9, and the 12th note is entered, the resultant entropy distribution is shown in FIG. 10. In this case, the expire rate is given to be 1.00. When the notes are sequentially entered, as shown in FIG. 11, and the seventh note is entered, the resultant entropy distribution is shown in FIG. 12. As apparent from FIG. 12, the diatonic-scale-entropy distribution has a peak for the tonality value "0". In this case, the expire rate is given to be 1.00. When the expire rate is given to be 0.85 and the notes are sequentially entered to the third note, as shown in FIG. 13, the resultant entropy distribution is shown in FIG. 14. As is apparent from FIG. 14, entropies for the tonality values of −3, −2, −1, 0, and +1 are equal. In this case, the middle value (i.e., the tonality value of −1) is selected. In addition, in the piece of music shown in FIG. 13, when the notes from the fourth to 22nd notes are entered, changes in entropy distributions are respectively illustrated in FIGS. 15 to 33. In these cases, the expire rate is given to be 0.85.

Figure 34:
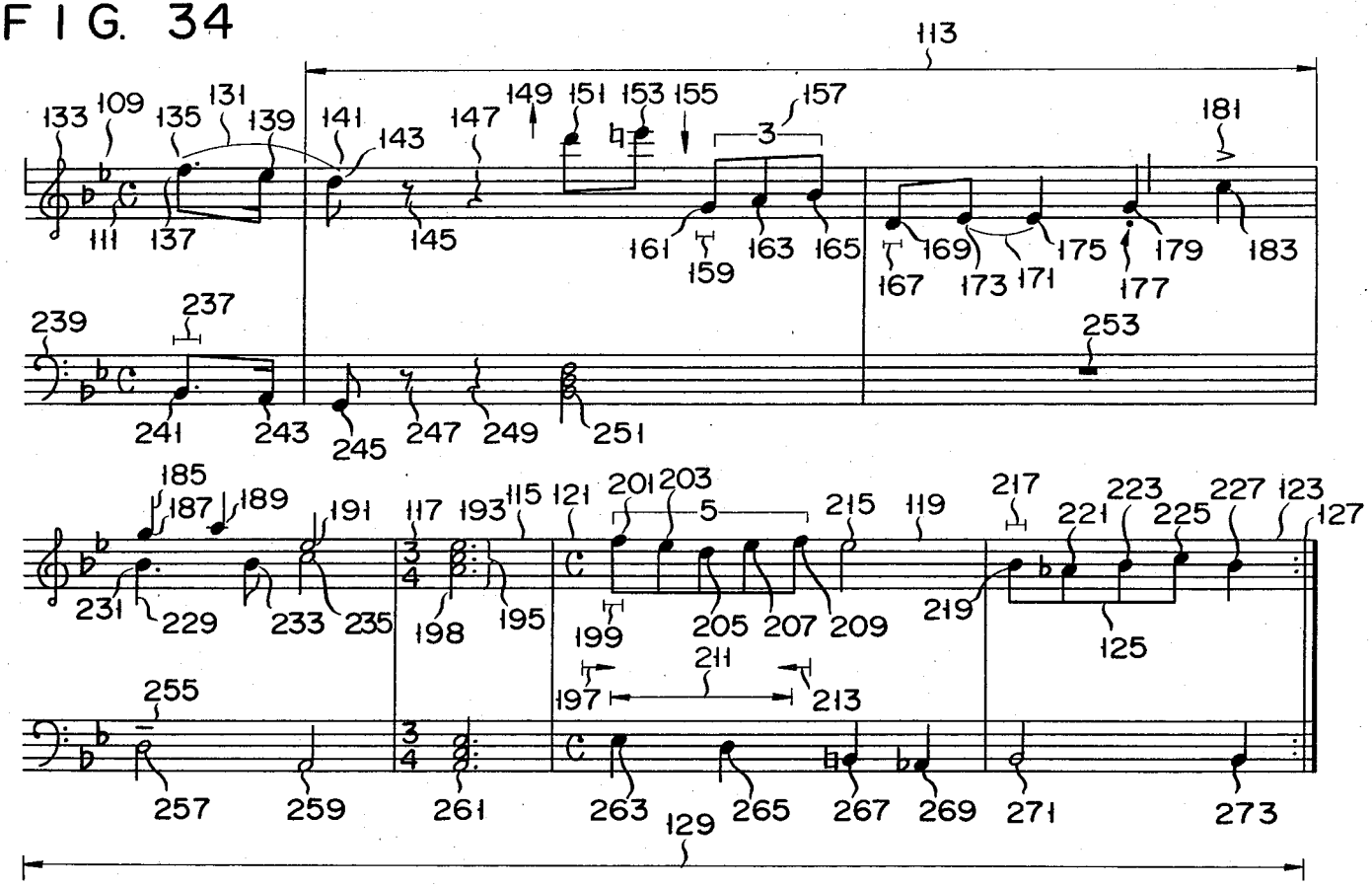
FIG. 34 is a representation showing part of a score to be entered by the input apparatus of the present invention.

An input operation of a musical sheet shown in FIG. 34 by means of the musical-sheet data-input device of the present invention will now be described. The next table shows the input sequence. Reference symbols TCC, O, NB, etc., denote function keys; and D5, E5, G4, etc., denote keys of the piano keyboard.

TABLE 8

| Input sequence | Reference numeral | Function |
|---|---|---|
| TCC | 111 | to specify the common time (C) |
| -2 | 109 | to specify two flats ($B^b$ major or G minor) |
| O14 | | to specify up-beat quarter notes |
| NB2 | 113 | to specify the number of measures in the first line consisting of treble and bass staffs |
| BA2 | 115 | to specify the second measure |
| T34 | 117 | to set the three-four time (3/4) |
| BA3 | 119 | to specify the third measure |
| TCC | 121 | to specify the common time (C) |
| BA4 | 123 | to specify the fourth measure |
| 1/2 ENDB 1/2 ENDB | 125 | to specify the end beat when the notes are connected by a stroke or beam in units of two-four times |
| T34 | | to specify the three-four time |
| TSI | | to inhibit writing of the time signature in the fourth measure in the second line consisting of treble and bass staffs |
| SRP002 | 127 | to specify the repeat mark |
| NB4 | 129 | to specify the number of measures in the second line to be 4 |
| TYP002 | | to specify a width and a length of a staff and a space between the adjacent staffs |
| NEXT | | to enter tone data |
| 1/8 | 131 | to specify an eighth note |
| 1/16 | | to specify a sixteenth note |
| IGK | 133 | to specify a treble clef |
| STA | | to automatically specify the direction of stems of the notes |
| LEGS | 135 | to specify the beginning of a slur |
| F5 | 137 | to enter data corresponding to the tone F (fa) (5 indicates the octave number) |
| 1/16 ES5 | 139 | to specify a sixteenth note and add a flat to the tone E to obtain the tone $E^b$ |
| LEGE | 141 | to specify the end of the slur |
| 1/8 D5 | 143 | to specify an eighth note and enter the tone D |
| REST | 145 | to specify a rest (since the eighth rest has the same duration as the eighth note specified in the immediately preceding step, the duration of the rest need not be specified.) |
| 1/4 REST | 147 | to specify a quarter rest |
| OC- | 149 | to specify playing at one lower octave |
| 1/8 D5 | 151 | to specify an eighth note and the tone D |
| E5 | 153 | to specify the tone E |
| NOC | 155 | to return to the normal octave |

TABLE 8-continued

| Input sequence | Reference numeral | Function |
|---|---|---|
| M-1 | 157 | to specify the beginning of the triplet |
| 1/8 | 159 | to specify the basic duration of the triplet |
| G4 | 161 | to specify the tone G |
| A5 | 163 | to specify the tone A |
| B5 | 165 | to specify the tone B |
| 1/4 | | to specify the total duration of the triplet |
| M-2 | | to specify the end of the triplet |
| 1/8 | 167 | to specify an eighth note |
| D4 | 169 | to specify the tone D |
| TIE | 171 | to specify a tie |
| ES4 | 173 | to specify the tone E♭ |
| 1/4 ES4 | 175 | to specify a quarter note and the tone E♭ |
| STC | 177 | to specify staccato |
| G4 | 179 | to specify the tone G |
| MCT | 181 | to specify marcato |
| C5 | 183 | to specify the tone C |
| STDU | 185 | to specify an upward stem |
| G5 | 187 | to specify the tone G |
| A6 | 189 | to specify the tone A |
| 1/2 ES5 | 191 | to specify a half note and the tone E♭ |
| STA 1/2 1/4 | 193 | to automatically specify the direction of the stems, and to specify half and quarter notes |
| A5 C5 ES5 | 195 | to enter a triad (the tones A, C and E♭ are simultaneously played.) |
| M-1 | 197 | to specify the beginning of a quintuplet |
| 1/8 | 199 | to specify an eighth note |
| F5 | 201 | to enter the tone F |
| ES5 | 203 | to enter the tone E♭ |
| D5 | 205 | to enter the tone D |
| ES5 | 207 | to enter the tone E♭ |
| F5 | 209 | to enter the tone F |
| 1/2 | 211 | to specify the total duration of the quintuplet |
| M-2 | 213 | to specify the end of the quintuplet |
| 1/2 ES5 | 215 | to specify a half note and the tone E♭ |
| 1/8 | 217 | to specify an eighth note and |
| B5 | 219 | enter the tone B♭ |
| GIS4 | 221 | to enter the tone A♭ |
| B5 | 223 | to enter the tone B♭ |
| C5 | 225 | to enter the tone C |
| 1/4 B5 | 227 | to specify a quarter note and enter the tone B♭ |
| NEXT | | to move to the next part |
| 1/4 | | to specify a quarter note |
| IGK | | to specify the treble clef |
| SMS | | to write on the same staff |
| NRE | | to specify a blank |
| 1/1 | | to specify a blank (B1, measure |
| NRE | | number 1) |
| NRE | | to specify a blank (B2, measure number 2) |
| STDD | 229 | to specify a downward stem |
| 1/4 1/8 B5 | 231 | to specify a dotted quarter note and enter the tone B♭ |
| 1/8 B5 | 233 | to specify an eighth note and enter the tone B♭ |
| 1/2 C5 | 235 | to specify a half note and enter the note C |
| STA 1/2 1/4 NRE | | to automatically specify the direction of the stem and make a blank corresponding to the duration of the dotted half note |
| 1/1 | | to make a blank corresponding to the value of the whole note |

TABLE 8-continued

| Input sequence | Reference numeral | Function |
|---|---|---|
| NRE 1/2 1/4 NRE | | to make a blank corresponding to the value of the dotted half note |
| NEXT | | to move to the next part |
| 1/8 1/16 | 237 | to specify a dotted eighth note |
| IFK | 239 | to specify a bass clef |
| B3 | 241 | to specify the tone B♭ |
| 1/16 A3 | 243 | to specify a sixteenth note and enter the tone A |
| 1/8 G2 | 245 | to specify an eighth note and enter the tone G |
| REST | 247 | to specify an eighth rest |
| 1/4 REST | 249 | to specify a quarter rest |
| 1/2 B3 D3 F3 | 251 | to enter a triad (the tones B♭, D and F are simultaneously played) |
| 1/1 REST | 253 | to specify a whole rest |
| TEN | 255 | to specify tenuto |
| 1/2 D3 | 257 | to specify a half note and enter the tone D |
| A3 | 259 | to enter the tone A |
| 1/2 1/4 A3 C3 ES3 | 261 | to enter a triad (the tones A, C and E♭ are simultaneously played) |
| 1/4 ES3 | 263 | to specify a quarter note and enter the tone E♭ |
| D3 | 265 | to enter the tone D |
| B3 | 267 | to enter the tone B♭ |
| GIS2 | 269 | to enter the tone A♭ |
| 1/2 B3 | 271 | to enter a half note and the tone B♭ |
| 1/4 B3 | 273 | to enter a quarter note and the tone B♭ |
| ENDC | | to end the key input operation |

As is apparent from the above input sequence, musical sheet data such as notes 153, 221, 267, and 269 which are to have an accidental added can be entered without performing any special operations.

What is claimed is:

1. An apparatus for inputting musical sheet data into a musical sheet printing system, comprising:

first musical keyboard means, having diatonic scale keys and chromatic scale keys, for allowing simultaneous entry of a plurality of notes and for generating first coded musical data;

second musical keyboard means, having a plurality of function keys and alphanumeric keys, for generating second coded musical data;

memory means, connected to said first and second musical keyboard means, for storing the first and second coded musical data; and controlling means for performing a predetermined operation on the first and second coded musical data and determining a tone and an accidental thereof.

2. An apparatus according to claim 1, wherein said controlling means includes a programmable microprocessor connected to said first and second music keyboard means and said memory means, said programmable microprocessor including a central processing unit for receiving the first and second coded musical data and a read-only memory device for storing a permanent program which is executed by said central processing unit and a conversion table representing a relationship between tonality values and chromatic tone pitches, so that said controlling means performs a predetermined operation in accordance with the permanent program; said controlling means controls said first and second keyboard means and said memory means such that a predetermined number of note data to be processed is preset for the first and second coded musical data, respective note data included in the predetermined number of note data are stored in said memory means and are accumulated, respective entropies are calculated in accordance with accumulated musical data, a tonality value having a maximum entropy is selected, and the accidental and tone are determined in accordance with the selected tonality value referring to the conversion table.

3. An apparatus according to claim 2, wherein the respective entropies are calculated in accordance with an equation $$H = -\sum_{i=1}^{N} Pi\log_2 Pi;$$

where H is an entropy and Pi is a probability of a number of times each of the musical data occurs.

4. An apparatus according to claim 2, further comprising displaying means for displaying the determined tone.

5. An apparatus according to claim 1, wherein said controlling means includes a programmable microprocessor connected to said first and second music keyboard means and said memory means; said programmable microprocessor including a central processing unit for receiving the first and second coded musical data and a read-only memory device for storing a permanent program which is performed by said central processing unit and a conversion table representing a relationship between tonality values and chromatic tone pitches, so that said controlling means performs a predetermined operation in accordance with the permanent program; said controlling means controls said first and second keyboard means and said memory means such that the first and second musical data are multiplied by a weighting coefficient, multiplied data are stored in said memory means and are accumulated, respective entropies are calculated in accordance with accumulated musical data, a tonality value having a maximum entropy is selected, and the accidental and tone are determined in accordance with the selected tonality value with reference to the conversion table.

6. An apparatus according to claim 5, wherein the respective entropies are calculated in accordance with an equation $$H = -\sum_{i=1}^{N} Pi\log_2 Pi;$$

where H is an entropy and Pi is a probability of a number of times each of the musical data occurs.

7. An apparatus according to claim 5, further comprising displaying means for displaying the determined tone.

8. An apparatus according to claim 1, wherein the respective entropies are calculated in accordance with an equation $$H = -\sum_{i=1}^{N} Pi\log_2 Pi;$$

where H is an entropy and Pi is a probability of a number of times each of the musical data occurs.

9. An apparatus according to claim 8, further comprising displaying means for displaying the determined tone.

10. An apparatus according to claim 1, further comprising displaying means for displaying the determined tone.

11. A method of entering musical sheet data in a musical sheet-printing system, comprising the steps of:

receiving pitch data;

classifying the pitch data in accordance with pitches thereof and accumulating the number of times pitch data occur for respective pitches;

classifying into 12 groups seven types of pitch data in a diatonic scale in accordance with accumulated data and generating grouped pitch data;

calculating an entropy of each group of said 12 groups in the diatonic scale in accordance with a relation:

$$H = -\sum_{i=1}^{N} Pi\log_2 Pi$$

where H is the entropy and Pi is the probability of occurence;

selecting a maximum entropy of entropies of the 12 groups; and determining an accidental and tone of the input data by referring to a conversion table representing a relationship between tonality and pitches of chromatic tones.

* * * * *